US010563913B2

(12) United States Patent
Currence et al.

(10) Patent No.: US 10,563,913 B2
(45) Date of Patent: Feb. 18, 2020

(54) SYSTEMS AND METHODS FOR HYDROCARBON REFRIGERATION WITH A MIXED REFRIGERANT CYCLE

(71) Applicant: Black & Veatch Holding Company, Overland Park, KS (US)

(72) Inventors: Kevin L. Currence, Olathe, KS (US); Daniel G. McCartney, Shawnee Mission, KS (US)

(73) Assignee: BLACK & VEATCH HOLDING COMPANY, Overland Park, KS (US)

( * ) Notice: Subject to any disclaimer, the term of this patent is extended or adjusted under 35 U.S.C. 154(b) by 571 days.

(21) Appl. No.: 14/466,820

(22) Filed: Aug. 22, 2014

(65) Prior Publication Data

US 2015/0135767 A1 May 21, 2015

Related U.S. Application Data

(60) Provisional application No. 61/904,895, filed on Nov. 15, 2013, provisional application No. 61/928,244, filed on Jan. 16, 2014.

(51) Int. Cl.
*F25J 3/02* (2006.01)
*F25J 1/00* (2006.01)
(Continued)

(52) U.S. Cl.
CPC ..... *F25J 1/0022* (2013.01); *C10L 3/101* (2013.01); *F25J 1/0045* (2013.01); *F25J 1/0052* (2013.01);
(Continued)

(58) Field of Classification Search
CPC ..... F25J 3/0209; F25J 3/0214; F25J 3/0233; F25J 3/0238; F25J 3/0242
See application file for complete search history.

(56) References Cited

U.S. PATENT DOCUMENTS 2,976,695 A 10/1961 Meade
3,191,395 A 6/1965 Maher et al.
(Continued)

FOREIGN PATENT DOCUMENTS

JP 200018049 1/2000
JP 20025398 1/2002
(Continued)

OTHER PUBLICATIONS

Gas Processors Suppliers Association (GPSA) Engineering Databook, Section 16, "Hydrocarbon Recovery," p. 16-13 through 16-20, 12th ed. (2004).

*Primary Examiner* — John F Pettitt, III
(74) *Attorney, Agent, or Firm* — Hovey Williams LLP

(57) ABSTRACT

Methods and systems for reducing the pressure of a hydrocarbon-containing stream so as to provide a cooled, reduced-pressure hydrocarbon-containing stream are provided. Facilities as described herein utilize a single closed-loop mixed refrigeration system in order to facilitate transportation, loading, and/or storage of a liquefied hydrocarbon-containing material at or near atmospheric pressure. In some aspects, the facilities can include at least one separation device for removing lighter components from the feed stream, which may separately be recovered as a vapor product for subsequent processing and/or use.

9 Claims, 9 Drawing Sheets

(51) Int. Cl.

| | |
|---|---|
| ***F25J 1/02*** | (2006.01) |
| ***C10L 3/10*** | (2006.01) |
| *C10L 3/12* | (2006.01) |

(52) U.S. Cl.

CPC ..... *F25J 1/0212* (2013.01); *F25J 1/0237* (2013.01); *F25J 1/0291* (2013.01); *F25J 3/0209* (2013.01); *F25J 3/0233* (2013.01); *F25J 3/0238* (2013.01); *C10L 3/12* (2013.01); *F25J 2200/02* (2013.01); *F25J 2200/74* (2013.01); *F25J 2205/02* (2013.01); *F25J 2205/04* (2013.01); *F25J 2210/04* (2013.01); *F25J 2215/04* (2013.01); *F25J 2215/62* (2013.01); *F25J 2215/64* (2013.01); *F25J 2220/04* (2013.01); *F25J 2230/08* (2013.01); *F25J 2230/60* (2013.01); *F25J 2240/40* (2013.01); *F25J 2245/02* (2013.01); *F25J 2245/90* (2013.01); *F25J 2290/34* (2013.01)

(56) References Cited

U.S. PATENT DOCUMENTS 3,210,953 A 10/1965 Reed
3,271,967 A 9/1966 Karbosky
3,596,472 A 8/1971 Stretch
3,729,944 A 5/1973 Kelley et al.
3,800,550 A 4/1974 Delahunty
3,932,154 A 1/1976 Coers et al.
4,033,735 A 7/1977 Swenson
4,036,028 A 7/1977 Mandrin
4,195,979 A * 4/1980 Martin ..... F25J 1/0022 62/613
4,217,759 A 8/1980 Shenoy
4,249,387 A 2/1981 Crowley
4,311,496 A 1/1982 Fabian
4,411,677 A 10/1983 Pervier et al.
4,525,187 A 6/1985 Woodward et al.
4,584,006 A 4/1986 Apffel
4,662,919 A 5/1987 Davis
4,676,812 A 6/1987 Kummann
4,707,170 A 11/1987 Ayres et al.
4,714,487 A 12/1987 Rowles
4,720,294 A 1/1988 Lucadamo et al.
4,727,723 A 3/1988 Durr
4,869,740 A 9/1989 Campbell et al.
4,878,932 A 11/1989 Phade et al.
5,051,120 A 9/1991 Pahade et al.
5,148,680 A 9/1992 Dray
5,182,920 A 2/1993 Matsuoka et al.
5,275,005 A 1/1994 Campbell et al.
5,351,491 A 10/1994 Fabian
5,377,490 A 1/1995 Howard et al.
5,379,597 A 1/1995 Howard et al.
5,398,497 A 3/1995 Suppes
5,497,626 A 3/1996 Howard et al.
5,502,972 A 4/1996 Howard et al.
5,555,748 A 9/1996 Campbell et al.
5,566,554 A 10/1996 Vijayaraghavan et al.
5,568,737 A 10/1996 Campbell et al.
5,596,883 A 1/1997 Bernhard et al.
5,615,561 A 4/1997 Houshmand et al.
5,657,643 A 8/1997 Price
5,771,712 A 6/1998 Campbell et al.
5,791,160 A 8/1998 Mandler et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,950,453 A 9/1999 Bowen et al.
5,979,177 A 11/1999 Sumner et al.
5,983,664 A 11/1999 Campbell et al.
5,983,665 A 11/1999 Howard et al.
5,992,175 A 11/1999 Yao et al.
6,003,603 A 12/1999 Breivik et al.
6,021,647 A 2/2000 Ameringer et al.
6,023,942 A 2/2000 Thomas et al.
6,035,651 A 3/2000 Carey
6,053,008 A 4/2000 Arman et al.
6,070,430 A 6/2000 McNeil et al.
6,085,546 A 7/2000 Johnston
6,105,390 A 8/2000 Bingham et al.
6,112,550 A 9/2000 Bonaquist et al.
6,182,469 B1 2/2001 Campbell et al.
6,260,380 B1 7/2001 Arman et al.
6,266,977 B1 7/2001 Howard et al.
6,295,833 B1 10/2001 Hoffart et al.
6,311,516 B1 11/2001 Key et al.
6,311,519 B1 11/2001 Gourbier et al.
6,330,811 B1 12/2001 Arman et al.
6,363,728 B1 4/2002 Udischas et al.
6,367,286 B1 4/2002 Price
6,401,486 B1 6/2002 Lee et al.
6,405,561 B1 6/2002 Mortko et al.
6,412,302 B1 7/2002 Foglietta
6,425,263 B1 7/2002 Bingham et al.
6,425,266 B1 7/2002 Roberts
6,427,483 B1 8/2002 Rashad et al.
6,438,994 B1 8/2002 Rashad et al.
6,449,982 B1 9/2002 Fischer
6,449,983 B2 9/2002 Pozivil
6,460,350 B2 10/2002 Johnson et al.
6,560,989 B1 5/2003 Roberts et al.
6,578,379 B2 6/2003 Paradowski
6,581,410 B1 6/2003 Johnson et al.
6,662,589 B1 12/2003 Roberts et al.
6,725,688 B2 4/2004 Elion et al.
6,745,576 B1 6/2004 Granger
6,823,691 B2 11/2004 Ohta
6,823,692 B1 11/2004 Patel et al.
6,915,662 B2 7/2005 Wilkinson et al.
6,925,837 B2 8/2005 Eaton
6,945,075 B2 9/2005 Wilkinson et al.
7,051,553 B2 5/2006 Mak et al.
7,069,744 B2 7/2006 Patel et al.
7,100,399 B2 9/2006 Eaton
7,107,788 B2 9/2006 Patel et al.
7,114,342 B2 10/2006 Oldham et al.
7,152,428 B2 12/2006 Lee et al.
7,152,429 B2 12/2006 Paradowski
7,159,417 B2 1/2007 Foglietta et al.
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar et al.
7,219,513 B1 5/2007 Mostafa
7,234,321 B2 6/2007 Maunder et al.
7,234,322 B2 6/2007 Hahn et al.
7,266,975 B2 9/2007 Hupkes-Van Der Toorn
7,310,972 B2 12/2007 Yoshida et al.
7,316,127 B2 1/2008 Huebel et al.
7,357,003 B2 4/2008 Ohara et al.
7,484,385 B2 2/2009 Patel et al.
7,614,241 B2 11/2009 Mostello
7,644,676 B2 1/2010 Lee et al.
7,713,497 B2 5/2010 Mak
7,793,517 B2 9/2010 Patel et al.
7,818,979 B2 10/2010 Patel et al.
7,841,288 B2 11/2010 Lee et al.
7,856,847 B2 12/2010 Patel et al.
8,505,312 B2 8/2013 Mak et al.
8,549,876 B2 10/2013 Kaart et al.
8,650,906 B2 2/2014 Price et al.
8,671,699 B2 3/2014 Rosetta et al.
2002/0166336 A1 11/2002 Wilkinson et al.
2003/0029190 A1 2/2003 Trebble
2003/0046953 A1 3/2003 Elion et al.
2004/0003625 A1* 1/2004 Fischer ..... F25J 1/0022 62/612
2004/0159122 A1 8/2004 Patel et al.
2005/0056051 A1 3/2005 Roberts et al.
2005/0204625 A1 9/2005 Briscoe et al.
2006/0260355 A1 11/2006 Roberts et al.
2006/0260358 A1 11/2006 Kun

(56) References Cited

U.S. PATENT DOCUMENTS

| | | | | |
|---|---|---|---|---|
| 2007/0157663 | A1 | 7/2007 | Mak et al. | |
| 2007/0231244 | A1 | 10/2007 | Shah et al. | |
| 2008/0066493 | A1* | 3/2008 | Buijs | F25J 3/0209 62/620 |
| 2008/0264076 | A1 | 10/2008 | Price et al. | |
| 2009/0193846 | A1 | 8/2009 | Foral et al. | |
| 2009/0205367 | A1 | 8/2009 | Price | |
| 2009/0217701 | A1 | 9/2009 | Minta et al. | |
| 2010/0043488 | A1 | 2/2010 | Mak et al. | |
| 2010/0064725 | A1 | 3/2010 | Chieng et al. | |
| 2010/0132405 | A1 | 6/2010 | Nilsen | |
| 2011/0289963 | A1 | 12/2011 | Price | |
| 2012/0000245 | A1 | 1/2012 | Currence et al. | |
| 2012/0060554 | A1* | 3/2012 | Schmidt | C10L 3/105 62/620 |
| 2012/0090324 | A1 | 4/2012 | Rosetta et al. | |
| 2012/0137726 | A1 | 6/2012 | Currence et al. | |
| 2013/0213807 | A1 | 8/2013 | Hanko et al. | |
| 2015/0308738 | A1* | 10/2015 | Ott | F25J 1/0022 62/623 |

FOREIGN PATENT DOCUMENTS

| | | | |
|---|---|---|---|
| JP | 2003232226 | 8/2003 | |
| WO | 2005045338 | 5/2005 | |
| WO | WO 2013087571 A2 * | 6/2013 | F25J 1/0255 |

* cited by examiner

SYSTEMS AND METHODS FOR HYDROCARBON REFRIGERATION WITH A MIXED REFRIGERANT CYCLE

CROSS-REFERENCE TO RELATED APPLICATIONS

This application claims the benefit under 35 U.S.C. § 119(e) of U.S. Provisional Application Ser. No. 61/904,895, filed on Nov. 15, 2013, and U.S. Provisional Application Ser. No. 61/928,244, filed on Jan. 16, 2014, both of which are incorporated herein by reference to the extent not inconsistent with the present disclosure.

BACKGROUND

1. Technical Field

One or more embodiments of the present invention relate to systems and methods for cooling a hydrocarbon-containing stream with a single closed-loop mixed refrigerant cycle.

2. Description of Related Art

Due to the high pressure required to maintain hydrocarbons, such as ethylene, ethane, propane, and propylene, in a liquefied state at ambient temperature, streams of these materials are typically refrigerated to very low temperatures so that the material can be loaded, transported, and/or stored at or near ambient pressure. Conventional systems for cooling hydrocarbon feed streams in this manner utilize propane and/or propylene as a cooling medium, but such refrigerants often lack sufficient refrigeration ability. As a result, many conventional cooling systems require multiple refrigeration cycles, including open-loop refrigeration cycles, and/or high levels of compression, to achieve the desired combination of pressure and temperature in the final product. Not only does this approach result in high operating expenses, but it also increases the capital requirement for such facilities due, in part, to the additional compression equipment and higher pressure rated vessels.

Thus, a need exists for an improved system for refrigerating hydrocarbon streams so that the materials can be transported, loaded, and/or stored at or near atmospheric pressure. Desirably, the system would require a minimal amount of equipment and would also be less expensive to operate than conventional systems. It would also be desirable that the system be capable of processing feeds having a wide range of compositions, including those with higher concentrations of more volatile components, with the optional capability of recovering the lighter components as a separate product stream.

SUMMARY

One embodiment of the present invention concerns a method for reducing the pressure of a hydrocarbon-containing stream so as to provide a cooled, reduced-pressure hydrocarbon-containing stream, the method comprising the following steps: (a) cooling the hydrocarbon-containing stream via indirect heat exchange with a mixed refrigerant to provide a warmed refrigerant stream and a cooled stream; (b) flashing at least a portion of the cooled stream to provide a two-phase fluid stream; (c) separating at least a portion of the two-phase fluid stream within a separator vessel into a vapor fraction and a liquid fraction; (d) introducing at least a portion of the liquid fraction into a holding vessel; (e) compressing at least a portion of the separated vapor fraction to provide a compressed vapor stream; (f) condensing at least a portion of the compressed vapor stream to provide a condensed stream; and (g) returning at least a portion of the condensed stream to the separator vessel or the holding vessel.

Another embodiment of the present invention concerns a method for reducing the pressure of a hydrocarbon-containing stream so as to provide a cooled, reduced-pressure hydrocarbon-containing stream, the method comprising: (a) cooling a hydrocarbon-containing stream via indirect heat exchange with a stream of mixed refrigerant to provide a cooled stream and a warmed refrigerant stream; (b) flashing at least a portion of the cooled stream to provide a flashed stream; (c) separating at least a portion of the flashed stream in a first vapor-liquid separator into a first vapor stream and a first liquid stream; (d) introducing at least a portion of the first liquid stream into a holding vessel; (e) compressing at least a portion of the first vapor stream to provide a compressed vapor stream; (f) separating at least a portion of the compressed vapor stream in a fractionation column to provide a light component-rich overhead stream and a light component-depleted bottoms stream; (g) cooling at least a portion of the light component-rich overhead stream to provide a cooled overhead stream; and (h) introducing a liquid portion of the cooled overhead stream into the upper portion of the fractionation column.

Still another embodiment of the present invention concerns a system for providing a cooled, reduced-pressure hydrocarbon-containing stream. The system comprises a primary heat exchanger comprising a first cooling pass for cooling the hydrocarbon-containing stream, wherein the first cooling pass comprises a warm fluid inlet and a cool fluid outlet. The system also comprises a first expansion device comprising a high pressure fluid inlet and a low pressure fluid outlet, wherein the high pressure liquid inlet is in fluid flow communication with the cool fluid outlet of the first cooling pass and a first vapor-liquid separator comprising a first fluid inlet, a first liquid outlet, and a first vapor outlet, wherein the first fluid inlet is in fluid flow communication with the low pressure fluid outlet of the first expansion device. The system further comprises at least one compressor comprising a first low pressure inlet and a first high pressure outlet, wherein the first low pressure inlet is in fluid flow communication with the first vapor outlet of the first vapor-liquid separator and wherein the first high pressure outlet is in fluid flow communication with the first fluid inlet of the first vapor-liquid separator and a holding vessel comprising a fluid inlet and a liquid outlet, wherein the fluid inlet is in fluid flow communication with the first liquid outlet of the first vapor-liquid separator.

The system also comprises a closed-loop mixed refrigeration cycle that comprises a refrigerant cooling pass disposed in the primary heat exchanger, wherein the refrigerant cooling pass has a warm refrigerant inlet and a cool refrigerant outlet and a refrigerant warming pass disposed in the primary heat exchanger, wherein the refrigerant warming pass has a cool refrigerant inlet and a warm refrigerant outlet. The cycle also comprises a refrigerant expansion device comprising a high pressure refrigerant inlet and a low pressure refrigerant outlet, wherein the high pressure refrigerant inlet is in fluid flow communication with the cool refrigerant outlet of the refrigerant cooling pass and the low pressure refrigerant outlet is in fluid flow communication with the cool refrigerant inlet of the refrigerant warming pass and a refrigerant compressor having a low pressure refrigerant inlet and a high pressure refrigerant outlet. The low pressure refrigerant inlet is in fluid flow communication with the warm refrigerant outlet of the refrigerant warming pass and the high pressure refrigerant outlet is in fluid flow communication with the warm refrigerant inlet of the refrigerant cooling pass.

BRIEF DESCRIPTION OF THE DRAWINGS

Various embodiments of the present invention are described in detail below with reference to the attached drawing Figures, wherein.

DETAILED DESCRIPTION

The following detailed description of embodiments of the invention references the accompanying drawings. The embodiments are intended to describe aspects of the invention in sufficient detail to enable those skilled in the art to practice the invention. Another embodiment can be utilized and changes can be made without departing from the scope of the claims. Additionally, it should be understood that references in the specification to "one embodiment," "an embodiment," or "other embodiment," and similar phrases mean that a particular feature, structure, or characteristic described in connection with the phrase is included in at least one embodiment of the invention. Features, structures, and characteristics described with respect to one embodiment are not necessarily limited to that embodiment and may be equally applied to any other embodiment, unless specifically described otherwise. The following detailed description is, therefore, not to be taken in a limiting sense. The scope of the present invention is defined only by the appended claims, along with the full scope of equivalents to which such claims are entitled.

The present invention generally relates to processes and systems for cooling and reducing the pressure of a hydrocarbon-containing fluid stream so that the stream can be processed, stored, and/or transported at or near atmospheric pressure. In particular, the present invention relates to optimized refrigeration processes and systems for cooling and depressurizing an incoming feed stream using a closed-loop refrigeration system that employs a single mixed refrigerant. According to various embodiments of the present invention, the refrigeration system may be optimized to provide efficient cooling for the feed stream, while minimizing the expenses associated with the equipment and operating costs of the facility.

Figure 1:
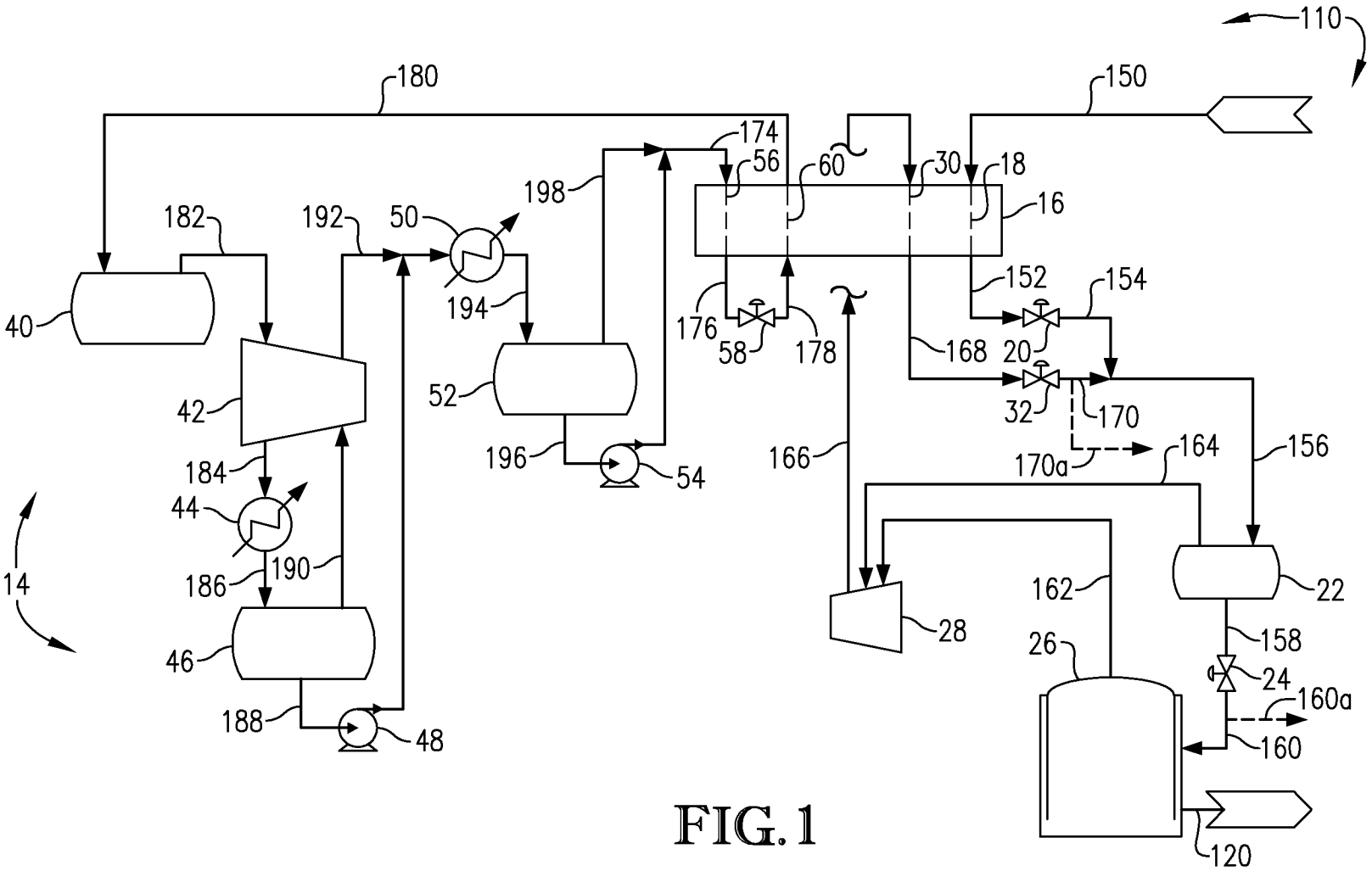
FIG. 1 provides a schematic depiction of a refrigeration system according to one embodiment of the present invention configured to cool a hydrocarbon-containing feed stream with a single closed-loop mixed refrigerant system.

Turning initially to FIG. 1, a schematic depiction of a refrigeration system 110 configured according to one or more embodiments of the present invention is provided. As shown in FIG. 1, refrigeration system 110 generally comprises a single closed-loop mixed refrigerant system 14, a primary heat exchanger 16, a vapor-liquid separator 22, a storage tank 26, and a flash gas compressor 28. Additional details regarding the configuration and operation of system 110 will be discussed in detail below.

As shown in FIG. 1, a hydrocarbon-containing fluid feed stream can be introduced into refrigeration system 110 via in conduit 150. As used herein, the term "fluid" refers to any flowable stream, including, for example, liquid streams, vapor streams, vapor-liquid streams, critical phase streams, supercritical streams, and combinations thereof. In one embodiment, unlike a liquefied natural gas (LNG) facility or NGL recovery facility, which typically process gas phase feed streams, the feed stream in conduit 150 introduced into refrigeration system 110 can be a predominantly liquid phase stream, or can be a stream that includes substantially no vapor-phase components. As used herein, the terms "predominantly" and "primarily" mean at least 50 volume percent, and "substantially no" means less than 5 volume percent. According to one embodiment, the hydrocarbon-containing stream introduced into heat exchanger 16 via in conduit 150 can have a vapor fraction of not more than about 0.15, not more than about 0.10, not more than about 0.05. In another embodiment, at least a portion, or all, of the hydrocarbon-containing stream in conduit 150 may be in a vapor phase, such that the vapor fraction can be at least about 0.25, at least about 0.40, or at least about 0.50.

The hydrocarbon-containing stream in conduit 150 can be any fluid stream that includes one or more hydrocarbon components. In one embodiment, the stream in conduit 150 can include at least about 50 volume percent, at least about 60 volume percent, at least about 70 volume percent, at least about 80 volume percent, or at least about 90 volume percent of one or more hydrocarbon components, including, for example, $C_2$ to $C_6$ hydrocarbon components. As used herein, the general term "$C_x$" refers to a hydrocarbon component comprising x carbon atoms per molecule and, unless otherwise noted, is intended to include all paraffinic and olefinic isomers thereof. Thus, "$C_2$" is intended to encompass both ethane and ethylene, while "$C_5$" is intended to encompass isopentane, normal pentane and all $C_5$ branched isomers, as well as $C_5$ olefins and diolefins. As used herein, the term "$C_x$ and heavier" refers to hydrocarbons having x or more carbon atoms per molecule (including paraffinic and olefinic isomers), while the term "$C_x$ and lighter" refers to hydrocarbons having x or less carbon atoms per molecule (including paraffinic and olefinic isomers).

According to one embodiment, the hydrocarbon-containing stream in conduit 150 can include at least about 70 volume percent, at least about 85 volume percent, or at least about 95 volume percent of $C_2$ and heavier components, based on the total volume of the stream. In some embodiments, the hydrocarbon-containing stream in conduit 150 can include less than about 10 volume percent, less than about 5 volume percent, less than about 2 volume percent, or less than about 1 volume percent $C_1$ and lighter components, while, in another embodiment, the amount of $C_1$ and lighter components in the hydrocarbon-containing stream in conduit 150 can be at least about 1 volume percent, at least about 2 volume percent, at least about 3 volume percent and/or not more than about 10 volume percent, not more than about 8 volume percent, or not more than about 5 volume percent, based on the total volume of the stream. In one embodiment, the stream in conduit 150 can include less than about 30 volume percent, less than about 15 volume percent, or less than about 5 volume percent of $C_3$ and heavier components.

The hydrocarbon-containing stream in conduit 150 can originate from any suitable source (not shown), such as another processing zone or a separation unit, or it may originate from a storage facility, pipeline, or production zone. In one embodiment, the hydrocarbon-containing stream in conduit 150 may be subjected to one or more pretreatment steps in a pretreatment zone (not shown) before being introduced into primary heat exchanger 16 of refrigeration system 110, as shown in FIG. 1. Suitable pretreatment steps can include, but are not limited to, dehydration or other steps for removing one or more undesired compounds. When the pretreatment zone includes a dehydration step, it may be carried out using any known water removal system, including, for example, beds of molecular sieve. The total water content of the hydrocarbon-containing stream in conduit 150 can be less than about 1000 parts per million by weight (ppmw), less than about 500 ppmw, less than about 50 ppmw, less than about 1 ppmw, based on the total mass of the stream.

The temperature of the hydrocarbon-containing stream in conduit 150 can be at least about 60° F., at least about 80° F., at least about 100° F. and/or not more than about 200° F., not more than about 175° F., not more than about 150° F. The pressure of the hydrocarbon-containing stream can vary, depending on the composition of the stream, but can be, for example, in the range of from about 450 psig, at least about 650 psig, at least about 850 psig and/or not more than about 2000 psig, not more than about 1750 psig, or not more than about 1500 psig.

As shown in FIG. 1, the hydrocarbon-containing feed stream in conduit 150 can be introduced into a warm fluid inlet of a first cooling pass 18 of a primary heat exchanger 16. Primary heat exchanger 16 can be any suitable type of heat exchanger operable to cool the incoming hydrocarbon-containing feed stream via indirect heat exchange with one or more cooling streams. In one embodiment, primary heat exchanger 16 can be a brazed aluminum heat exchanger comprising a plurality of cooling and warming passes (e.g., cores disposed therein for facilitating indirect heat exchange between one or more process streams and one or more refrigerant steams. Although generally illustrated as comprising a single outer "shell," in FIG. 1, it should also be understood that primary heat exchanger 16 may, in some embodiments, include two or more separate shells, optionally encompassed by a "cold box" to minimize the introduction of heat from the surrounding environment.

As the hydrocarbon-containing feed stream passes through cooling pass 18 of primary heat exchanger 16, the stream may be cooled via indirect heat exchange with a yet-to-be-discussed stream of mixed refrigerant. In one embodiment, the feed stream in conduit 150 can be cooled by at least about 125° F., at least about 175° F., at least about 200° F. as it passes through cooling pass 18. The resulting cooled stream withdrawn from primary heat exchanger 16 in conduit 152 can have a temperature of at least about −50° F., at least about −80° F., at least about −130° F. and/or not more than about −10° F., not more than about −25° F., not more than about −40° F. The vapor fraction of the stream in conduit 152 can be less than about 0.005, less than about 0.001, or it can be 0.

As shown in FIG. 1, the cooled hydrocarbon: containing stream in conduit 152 withdrawn from primary heat exchanger 16 can be passed through at least one expansion device, shown as valve 20, wherein the pressure of the stream may be reduced. Expansion device 20 can be any suitable type of liquid expansion device and, in one embodiment, may be, for example, a Joule-Thomson valve. The resulting two-phase stream in conduit 154, which includes the entire hydrocarbon-containing feed stream in line 150, may have a pressure of at least about 5 psig, at least about 30 psig, at least about 50 psig and/or not more than about 200 psig, not more than about 150 psig, not more than about 100 psig, and can be combined with a yet-to-be-discussed stream in conduit 170 to form a combined fluid stream in conduit 156. The temperature of the combined fluid stream in conduit 156 can be at least about 180° F., at least about 150° F., at least about −125° F. and/or not more than about −25° F., not more than about −50° F., not more than about −75° F.

As shown in FIG. 1, the combined stream in conduit 156 can then be passed into a vapor-liquid separator 22, wherein the vapor and liquid portions may be separated. Separator 22 can be any suitable type of vapor-liquid separation vessel and may include any number of actual or theoretical separation stages. In one embodiment, vapor-liquid separation vessel may comprise a single separation stage, while, in another embodiment, separation vessel 22 can include two or more separation stages. When separator 22 comprises a single-stage separation vessel, few or no internals may be employed. The liquid phase stream withdrawn from a liquid outlet of vapor-liquid separator 22 via conduit 158 can be further expanded via passage through another expansion device, shown as valve 24, before being routed via conduit 160 and/or **160*a* to a lower pressure zone. In one embodiment, the lower pressure zone may comprise a holding vessel, illustrated in FIG. 1 as a storage tank 26, and the expanded fluid stream may be introduced storage tank 26 via conduit 160. Alternatively, or in addition, at least a portion of the expanded fluid stream may be routed to another lower pressure location, such as, for example, one or more of a ship, a barge, a truck, or a railcar via conduit 160*a*. The pressure of the expanded fluid stream in conduit 160 and/or 160*a*** can be less than about 40 psig, less than about 20 psig, less than about 10 psig, or less than about 5 psig.

The lower pressure zone or holding vessel can be any suitable vessel or space configured to hold the liquefied product stream in conduit 160 for at least some length of time and it can be stationary, mobile, or semi-mobile. In some embodiments, a portion of the liquefied product stream can be transferred from the holding vessel to another holding or transportation vessel (not shown) via conduit 120. In one embodiment, the lower pressure zone or holding vessel can be a storage tank (e.g., storage tank 26 shown in FIGS. 1-3), a truck, a rail car, barge, and/or a ship. Advantageously, the holding vessel can be designed to store or transport the liquefied product introduced via conduit 160 at or near atmospheric pressure such that, for example, the pressure within the holding vessel can be within about 40 psi, within about 20 psi, within about 10 psi, within about 5 psi of atmospheric pressure.

As shown in FIG. 1, the vapor phase stream withdrawn from an outlet of vapor-liquid separator 22 via conduit 164, which can have a pressure of at least about 5 psig, at least about 30 psig, at least about 50 psig and/or not more than about 200 psig, not more than about 150 psig, not more than about 100 psig, may be passed to an inlet of a flash gas compressor 28. Flash gas compressor 28 can be any suitable type of compressor for increasing the pressure of the vapor stream and, in one embodiment, may be a multi-stage compressor having at least 2, at least 3, or at least 4 compression stages. When flash gas compressor 28 includes multiple stages, it may also employ one or more interstage coolers and/or separators (not shown).

In one embodiment depicted in FIG. 1, boil-off vapor may evolve from the liquid stream in conduit 160 within, or prior to, its introduction into storage tank 26, due to, for example, leakage of heat into the system, vaporization of low boiling components during expansion, and/or loading and unloading of storage tank 26. According to one embodiment, a stream of boil-off vapor may be withdrawn from storage tank 26 via conduit 162 and passed into an inlet of flash gas compressor 28. The pressure of the boil-off vapor in conduit 162 can be less than about 15 psig, less than about 10 psig, or less than about 5 psig, which may be lower than the pressure of the vapor phase stream withdrawn from separator 22 via conduit 164. When the pressure of the boil-off vapor stream is lower than the pressure of the vapor phase stream in conduit 164, the boil-off vapor stream may be introduced into a lower compression stage of flash gas compressor 28, as shown in FIG. 1, or into a separate compressor (not shown in FIG. 1). The compressed vapor stream exiting the high pressure outlet of flash gas compressor 28 via conduit 166 can have a pressure of at least about 150 psig, at least about 300 psig, at least about 450 psig and/or not more than about 750 psig, not more than about 700 psig, not more than about 650 psig.

According to one embodiment illustrated in FIG. 1, the compressed stream in conduit 166 can be routed to a cooling pass 30 located within primary heat exchanger 16, wherein the pressurized vapor stream can be cooled and at least partially condensed via indirect heat exchange with a yet-to-be-discussed stream of mixed refrigerant. In another embodiment, the compressed vapor stream in conduit 166 may be cooled in a heat exchanger separate from primary exchanger 16 (not shown). The resulting cooled, compressed stream in conduit 168 can have a temperature of at least about −50° F., at least about −80° F., at least about −130° F. and/or not more than about −10° F., not more than about −25° F., not more than about −40° F.

As shown in FIG. 1, the entire cooled stream in conduit 168 can then be passed through an expansion device, shown as valve 32, wherein the stream may be further cooled and its pressure reduced. The resulting two-phase fluid stream in conduit 170 may then be optionally combined in its entirety with the flashed, cooled liquid stream in conduit 154 and the entirety of the combined stream in conduit 156 may be introduced into vapor-liquid separator 22, as discussed in detail previously. In an alternative embodiment, the streams in conduit 168 and 152 can be combined prior to expansion and the combined stream may be passed through a single expansion device (not shown). In another alternative embodiment, the flashed streams in conduits 154 and 170 may not be combined, but instead, may be separately introduced into separate inlets (not shown) of vapor-liquid separator 22. In another embodiment, at least a portion of the flashed stream in conduit 170 may be withdrawn via conduit 170 *a* and routed to a different lower pressure zone (not shown) than the stream in conduit 156. As shown in FIG. 1, once introduced into vapor-liquid separator 22, the cooled hydrocarbon-containing stream or streams may proceed through refrigeration facility 110 as previously described.

As shown in FIG. 1, a predominantly liquid-phase product stream can be withdrawn from storage tank 26 via conduit 120. Depending on the composition of the liquid product, the stream in conduit 120 can have a temperature of at least about −175° F., at least about −140° F., at least about −120° F. and/or not more than about −50° F., not more than about −75° F., not more than about −100° F. and a vapor fraction of less than about 0.10, less than about 0.05, or less than about 0.01. In one embodiment, the product stream in conduit 120 can be enriched in $C_2$ and heavier components, such that it comprises less than about 10 volume percent, less than about 5 volume percent, less than about 2 volume percent, or less than about 1 volume percent of $C_1$ and lighter components, based on the total volume of the stream. The stream in conduit 120 can be removed from storage tank 26 at a continuous or intermittent frequency and may be passed to a downstream storage, processing, or transportation device (not shown) for further processing, storage, and/or use.

Turning now to the refrigeration portion of refrigeration facility 110 depicted in FIG. 1, one embodiment of a closed-loop mixed refrigerant system 14 is illustrated as generally comprising a refrigerant suction drum 40, a refrigerant compressor 42, an interstage cooler 44, an interstage separator 46, a refrigerant condenser 50, a refrigerant separator 52, a refrigerant cooling pass 56, a refrigerant expansion device 58, and a refrigerant warming pass 60, wherein the refrigerant cooling pass and the refrigerant warming pass 60 can be disposed within primary heat exchanger 16. In one embodiment, mixed refrigeration system 14 may not employ any type of open-loop or cascade refrigeration cycle and, as a result, the feed stream introduced into refrigeration facility 110 may not be used as a refrigerant within system 14. The operation of mixed refrigerant system 14 will now be described in more detail below with respect to FIG. 1.

As shown in FIG. 1, a stream of mixed refrigerant in conduit 180 can be introduced into refrigerant suction drum 40. As used herein, the term "mixed refrigerant" refers to a refrigerant composition comprising two or more constituents. In one embodiment, the mixed refrigerant utilized by refrigeration cycle 14 can comprise two or more constituents selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can substantially exclude certain components, including, for example, nitrogen or halogenated hydrocarbons. According to one embodiment, the refrigerant composition can have an initial boiling point of at least −140° F., at least −90° F., or at least −40° F. and/or less than 0° F., less than −10° F., or less than −30° F. Various specific refrigerant compositions can be used according to embodiments of the present invention. Table 1, below, summarizes broad, intermediate, and narrow ranges for several exemplary refrigerant mixtures.

TABLE 1

| Exemplary Mixed Refrigerant Compositions | | | |
|---|---|---|---|
| Component | Broad Range, mole % | Intermediate Range, mole % | Narrow Range, mole % |
| methane | 0 to 50 | 0 to 30 | 5 to 20 |
| ethylene | 0 to 70 | 10 to 50 | 20 to 50 |
| ethane | 0 to 70 | 10 to 50 | 20 to 50 |
| propylene | 0 to 50 | 5 to 40 | 10 to 30 |
| propane | 0 to 50 | 5 to 40 | 10 to 30 |
| i-butane | 0 to 10 | 0 to 5 | 0 to 2 |
| n-butane | 0 to 25 | 0 to 20 | 0 to 15 |
| i-pentane | 0 to 40 | 5 to 30 | 1 to 25 |
| n-pentane | 0 to 10 | 0 to 5 | 0 to 2 |

Referring again to FIG. 1, the mixed refrigerant stream withdrawn from suction drum 40 via conduit 182 can be routed to a suction inlet of refrigerant compressor 42, wherein the pressure of the refrigerant stream can be increased. When refrigerant compressor 42 comprises a multistage compressor having two or more compression stages, a partially compressed refrigerant stream exiting the first (low pressure) stage of compressor 42 can be routed via conduit 184 to interstage cooler 44, wherein the stream can be cooled and at least partially condensed via indirect heat exchange with a cooling medium (e.g., cooling water or air).

The resulting two-phase refrigerant stream in conduit 186 can then be introduced into interstage separator 46, wherein the vapor and liquid portions can be separated. A vapor stream withdrawn from separator 46 via conduit 190 can be routed to the inlet of the second (high pressure) stage of refrigerant compressor 42, wherein the stream can be further compressed. The resulting compressed refrigerant vapor stream in conduit 192, which can have a pressure of at least about 150, at least about 200, or at least about 250 psig and/or less than about 600, less than about 550, less than about 500 can be recombined with a portion of the liquid phase refrigerant withdrawn from interstage separator 144 in conduit 188 and pumped to a higher pressure via refrigerant pump 48, as shown in FIG. 1.

The resulting combined two-phase refrigerant stream can then be introduced into refrigerant condenser 50, wherein the pressurized fluid stream can be cooled and at least partially condensed via indirect heat exchange with a cooling medium (e.g., cooling water) before being introduced into refrigerant separator 52 via conduit 194. As shown in FIG. 1, the vapor and liquid portions of the two-phase refrigerant stream introduced into separator 52 in conduit 194 can be separately withdrawn from separator 52 via respective vapor and liquid conduits 198 and 196. A portion of the liquid stream in conduit 196, optionally pressurized via refrigerant pump 54, can be combined with the vapor stream in conduit 174 just prior to or within a refrigerant cooling pass 56.

As it flows through refrigerant cooling pass 56, the stream of mixed refrigerant can be condensed and sub-cooled, such that the temperature of the liquid refrigerant stream withdrawn from primary heat exchanger 16 via conduit 176 can be well below the bubble point of the refrigerant mixture. The sub-cooled refrigerant stream in conduit 176 can then be expanded via passage through a refrigerant expansion device 58 (illustrated in FIG. 1 as a Joule-Thomson valve), wherein the pressure of the stream can be reduced, thereby cooling and at least partially vaporizing the refrigerant stream to generate refrigeration. The cooled, two-phase refrigerant stream in conduit 178 can then be routed through a refrigerant warming pass 60, wherein a substantial portion of the refrigeration generated can be used to cool or sub-cool one or more process streams, including at least one of the feed stream in cooling pass 18, the compressed vapor stream in cooling pass 30 (when present), and the two-phase refrigerant stream in refrigerant cooling pass 56. The resulting warmed refrigerant stream withdrawn from primary heat exchanger 16 via conduit 180 can then be routed to the inlet of refrigerant suction drum 40 before being compressed and recycled through closed-loop refrigeration cycle 14 as previously discussed.

According to one embodiment of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed stream introduced into the refrigeration facility. In one embodiment, the composition of the mixed refrigerant can be adjusted such that the heating curve of the vaporizing refrigerant more closely matches the cooling curve of the feed stream. One method for such curve matching is described in detail, with respect to an LNG facility, in U.S. Pat. No. 4,033,735, incorporated herein by reference to the extent not inconsistent with the present disclosure.

Figure 2:
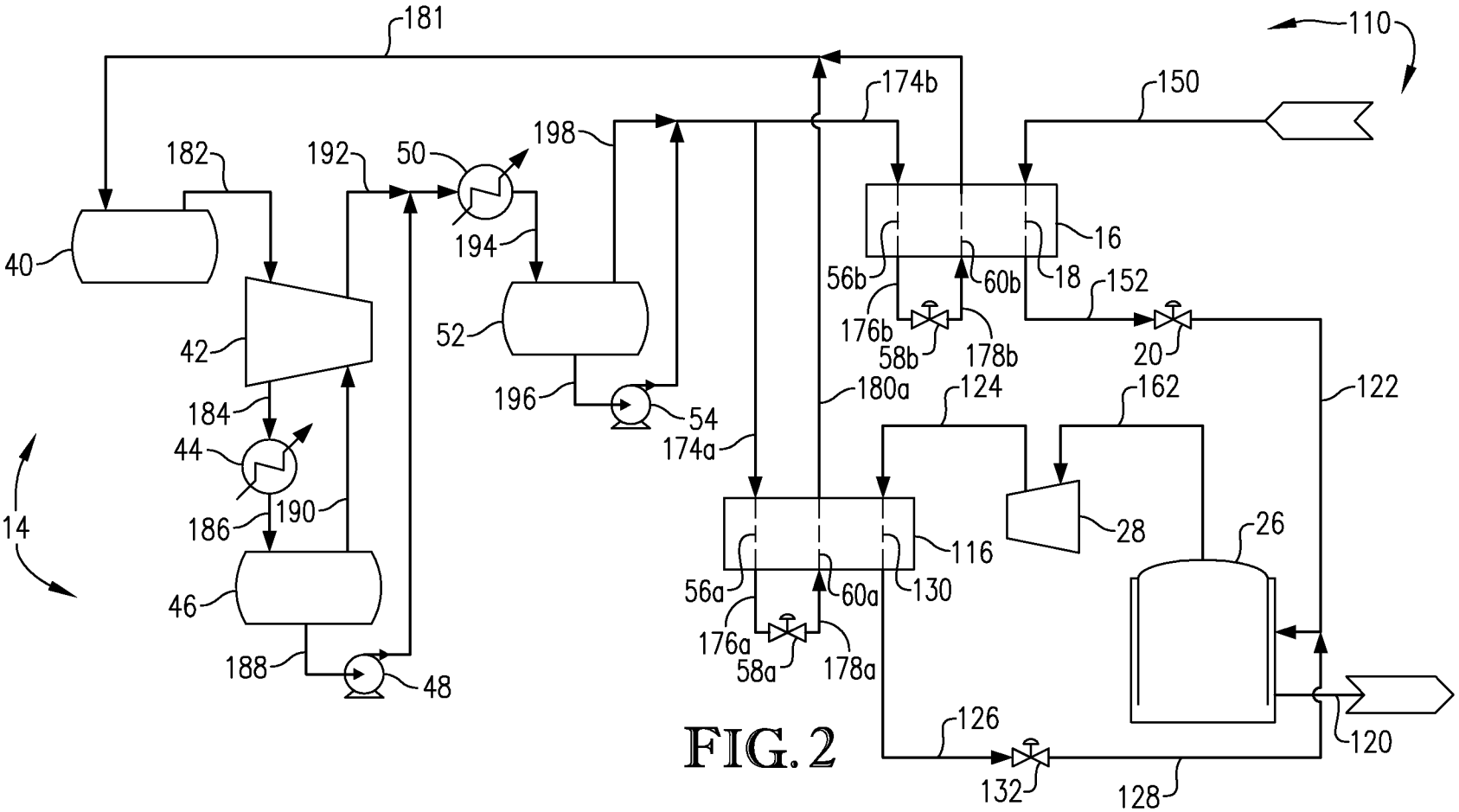
FIG. 2 provides a schematic depiction of a refrigeration system according to another embodiment of the present invention, similar to the refrigeration system depicted in FIG. 1, but not including a vapor-liquid separation vessel.

Referring now to FIG. 2, a schematic depiction of another embodiment of refrigeration facility 110 is provided. As described in detail previously with respect to FIG. 1, refrigeration facility 110 generally includes primary heat exchanger 16, a holding vessel, shown as storage tank 26, a flash gas compressor 28, and a closed-loop mixed refrigerant cycle 14. However, in the embodiment depicted in FIG. 2, refrigeration facility 110 does not include a vapor-liquid separation vessel 22.

In one embodiment, the refrigeration facility 110 shown in FIG. 2 may be utilized when the expanded fluid stream in conduit 122 includes little or no vapor-phase components. In one embodiment, the vapor fraction of the stream in conduit 122 can be less than about 0.25, less than about 0.15, less than about 0.10, less than about 0.05, or 0. In one embodiment, such a facility 110 may also be used when the composition of the feed stream in conduit 150 includes smaller amounts of $C_1$ and lighter components. For example, in one embodiment, the stream in conduit 150 introduced into refrigeration facility 110 of FIG. 2 may include less than about 10 volume percent, less than about 5 volume percent, or less than about 2 volume percent of $C_1$ and lighter components. In some embodiments, the feed stream in conduit 150 can comprise a $C_2/C_3$ mix such that at least about 10 volume percent, at least about 20 volume percent, at least about 30 volume percent, at least about 40 volume percent and/or not more than about 90 volume percent, not more than about 80 volume percent, not more than about 70 volume percent, not more than about 60 volume percent of the feed stream comprises $C_2$ components, with the balance being $C_3$ components and trace amounts of lighter and/or heavier materials. The operation of the refrigeration facility 110 shown in FIG. 2, as it differs from that described previously with respect to FIG. 1, will now be discussed in detail below.

Turning initially to the cooled fluid stream exiting primary heat exchanger 16 via conduit 152 shown in FIG. 2, the cooled stream can be passed through an expansion device 20, wherein the pressure of the stream is reduced. Although shown in FIGS. 1 and 2 as comprising an expansion valve, it should also be understood that other devices, such as, for example, a turboexpander (not shown) can also be used to carry out the expansion of the stream in conduit 152 or any other expansion in the system. Similarly, one or more of the expansion steps shown in FIGS. 3-5 may also be carried out using a turboexpander. In some embodiments, when a turboexpander is used, at least a portion of the energy generated by the turboexpander may be recovered and utilized elsewhere in refrigeration facility 110, such as, for example, in one of compressors 28 or 42, or in another compressor or for the generation of electric power (not shown).

As shown in FIG. 2, the resulting expanded stream in conduit 122 can then be optionally combined with the yet-to-be-discussed expanded stream in conduit 128 before being introduced into a lower pressure zone. In the embodiment depicted in FIG. 2, the lower pressure zone comprises a holding vessel, shown as storage tank 26, although the stream may also be routed to another location, depending on the specific configuration of refrigeration facility 110. Additionally, in one embodiment (not shown), a portion of the expanded stream in conduit 122 may be separately introduced into storage tank 26 (or other lower pressure location) and may not be combined with the expanded stream in conduit 128.

In a similar manner as described with respect to FIG. 1, a boil-off vapor stream may be withdrawn from storage tank 26 via conduit 162 and may be introduced into a low pressure inlet of compressor 28. The resulting compressed stream in line 124 discharged from the high pressure outlet of compressor 28 may then be introduced into a cooling pass 130 contained within a second heat exchanger 116. As the stream passes through cooling pass 130, it is cooled via indirect heat exchange with a stream of mixed refrigerant, shown in FIG. 2 as yet-to-be-discussed mixed refrigerant stream introduced into a refrigerant warming pass 60*a* via conduit 178*a*. The resulting cooled fluid stream in conduit 126 may then be expanded via passage through an expansion device, shown in FIG. 2 as an expansion valve 132, and the resulting expanded stream in conduit 128 may optionally be combined with the expanded fluid stream in conduit 122 before being passed into storage tank 26 or another lower pressure location (not shown).

In the embodiment depicted in FIG. 2, the compressed boil-off stream in conduit 124 and the feed stream in conduit 150 can be cooled in separate heat exchangers, shown as respective exchangers 116 and 16. Alternatively, both streams may be cooled in a single exchanger, as generally illustrated in FIG. 1. When two or more separate exchangers are utilized, the combined mixed refrigerant stream in conduit 198 may be divided into a first refrigerant portion in conduit 174*a* and a second refrigerant portion in conduit 174*b*, which can respectively be introduced into first and second refrigerant cooling passes 56*a* and 56*b*, wherein the refrigerant streams can be cooled.

As shown in FIG. 2, the resulting cooled refrigerant streams in respective conduits 176*a* and 176*b* may then be expanded via passage through expansion devices 58*a* and 58*b*, and the resulting cooled, expanded refrigerant streams in conduits 178*a* and 178*b* may then be introduced into respective refrigerant warming passes 60*a* and 60*b*, wherein the streams are warmed via indirect heat exchange with one or more incoming streams. In particular, the cooled, compressed refrigerant stream in conduit 178*a* can be used to cool the warm refrigerant stream passed through cooling passage 176*a* and the compressed boil-off vapor passed through cooling passage 130, while the refrigerant stream in conduit 176*b* can be used to cool the refrigerant stream introduced into cooling passage 56*b* and the feed stream introduced into heat exchanger 16 via conduit 150. The warmed refrigerant streams withdrawn from heat exchangers 16 and 116 via respective conduits 180*a* and 180*b* can be combined and the resulting stream in conduit 181 may pass through closed-loop refrigeration cycle 14 as discussed in detail previously.

Figure 3:
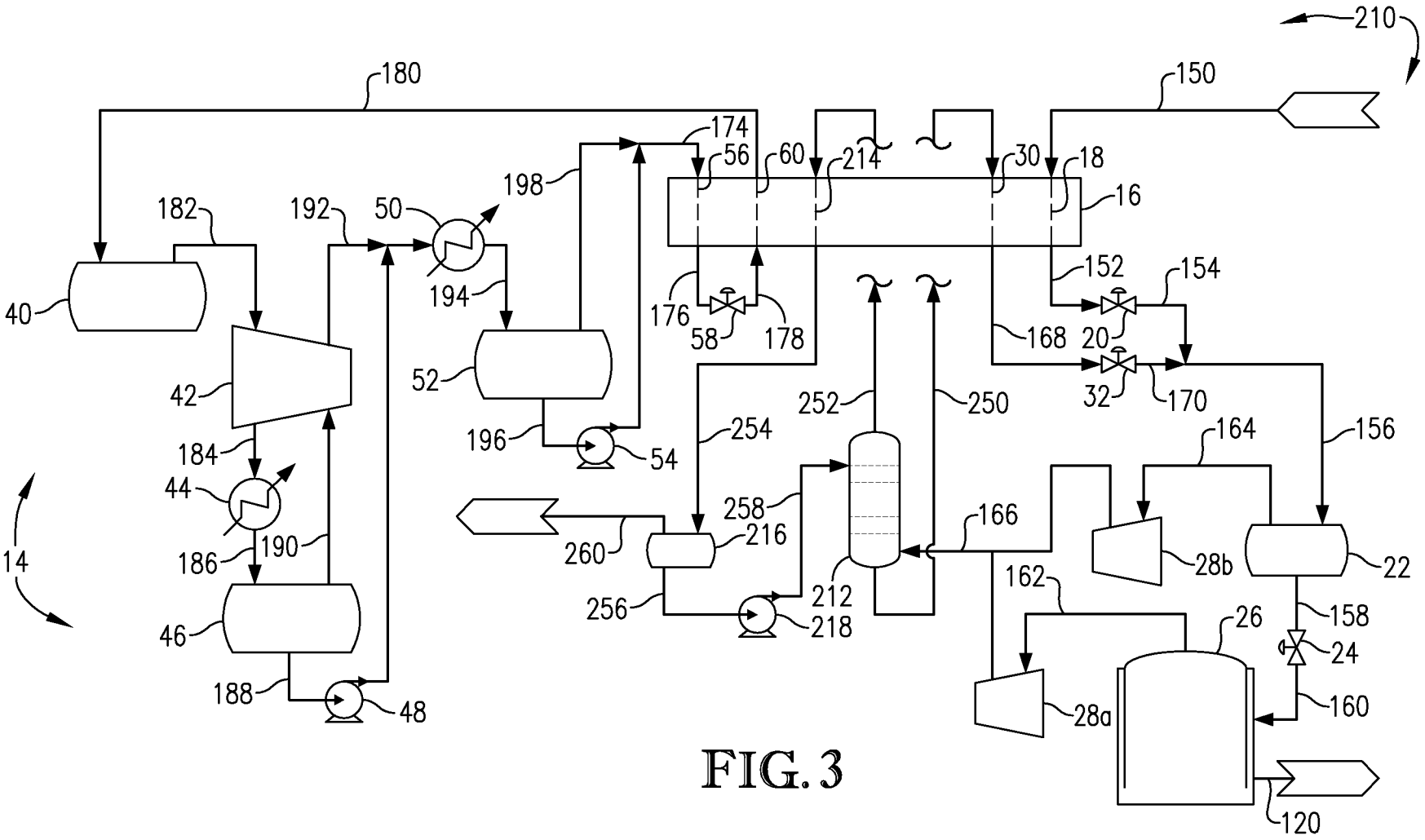
FIG. 3 provides a schematic depiction of a refrigeration system according to yet another embodiment of the present invention, particularly illustrating the use of a fractionation column to recover excess light ends from the hydrocarbon-containing feed stream.

Referring now to FIG. 3, a schematic depiction of another refrigeration facility 210 configured according to one embodiment of the present invention is provided. Refrigeration facility 210 is illustrated as generally comprising a primary heat exchanger 16, a vapor-liquid separator 22, a storage tank 26, a pair of flash gas compressors 28*a* and 28*b*, and a closed-loop mixed refrigerant cycle 14, each of which is configured in a similar manner to those described previously with respect to refrigeration facility 110 shown in FIG. 1. In addition, refrigeration facility 210 shown in FIG. 3 also includes a fractionation column 212 and another vapor-liquid separator 216 to further separate the lighter components (such as $C_1$) from the hydrocarbon-containing feed stream. The operation of refrigeration facility 210, as it differs from that of refrigeration facility 110 described previously, will now be discussed in detail below, with respect to FIG. 3.

Turning initially to vapor-liquid separation vessel 22, a vapor phase stream withdrawn from separation vessel 22 via conduit 164 can be routed to a first low pressure inlet of one of the compressors, shown in FIG. 3 as compressor 28*b*. The resulting pressurized stream discharged from compressor 28*b* can be combined in conduit 166 with a yet-to-be-discussed stream discharged from the other compressor, compressor 28*a*. The combined stream can then be introduced into a fluid inlet of fractionation column 212. When multiple compressors are utilized, as shown in FIG. 2, the boil-off vapor stream in conduit 162 withdrawn from storage tank 26 can be introduced into another low pressure inlet of the other compressor 28*a*, wherein the pressure of the stream is increased. Depending on the specific configuration of refrigeration facility 110, the amount of compression provided by compressor 28*a* may be higher than that provided by compressor 28*b*, due to, for example, the lower pressure of the stream in conduit 162. As shown in FIG. 3, the compressed boil-off vapor stream discharged from the high pressure outlet of compressor 28*a* can be combined with the compressed stream discharged from the outlet of compressor 28*b* and the combined stream may then be introduced into fractionation column 212. Alternatively, the compressed streams may be introduced separately into fractionation column 212. Although shown in FIG. 3 as comprising two separate compressors 28*a* and 28*b*, it should also be understood that a single, multistage compressor could also be utilized without departing from the spirit of the present invention.

According to one embodiment, fractionation column 212 can be operable to separate a feed stream into a light component-enriched overhead stream, withdrawn from an upper vapor outlet of column 212, and a light component-depleted bottoms stream withdrawn from a lower liquid outlet of column 212. In one embodiment, fractionation column 212 may be configured to separate $C_1$ and lighter components from a fluid stream and can, for example, be configured to separate at least 65, at least 75, at least 85, at least 90, or at least 99 percent of the $C_1$ and lighter components from the pressurized fluid stream in conduit 166.

Fractionation column 212 can comprise any suitable type of vapor-liquid separation vessel and, although shown in FIG. 3 as being a single vessel, two or more vessels, configured for operation in parallel or series, may also be used. In one embodiment, fractionation column 212 can be a multi-stage fractionation column comprising at least 2, at least 8, at least 10, at least 12 and/or less than 50, less than 35, or less than 25 actual or theoretical separation stages. When fractionation column 212 comprises a multi-stage column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof. In one embodiment, fractionation column 212 may include at least one reboiler (not shown in FIG. 3) positioned at or near the bottom of fractionation column 212.

According to in one embodiment depicted in FIG. 3, fractionation column 212 may comprise an absorber column that includes a lower feed inlet disposed in the lower one-half, the lower one-third, or the lower one-fourth of the total volume of fractionation column 212, and at least one upper liquid inlet located in the upper one-half, upper one-third, or upper one-fourth of the volume of fractionation column 212. According to this embodiment, a predominantly vapor stream having, for example, a vapor fraction of at least about 0.75, at least about 0.85, at least about 0.95, may be introduced into the lower portion of fractionation column 212 and, as it ascends, it can be contacted with a yet-to-be-discussed liquid stream introduced into an upper portion of fractionation column 212. According to one embodiment, the overhead (top) pressure of fractionation column 212 can be at least about 200 psig, at least about 400 psig, or at least about 600 psig and/or less than about 900 psig, less than about 800 psig, or less than about 700 psig and the overhead (top) temperature can be at least about −50° F., at least about −80° F., at least about −130° F. and/or not more than about −10° F., not more than about −25° F., not more than about −40° F.

As shown in FIG. 3, a liquid stream withdrawn from a lower liquid outlet of fractionation column 212 via conduit 250 can be introduced into a cooling pass 30 disposed in primary heat exchanger 16, wherein the stream can be sub-cooled via indirect heat exchange with a stream of mixed refrigerant passing through refrigerant warming pass 60, as described in detail previously. In another embodiment (not shown in FIG. 3), the liquid stream in conduit 250 can be cooled in a different heat exchanger, separate from primary heat exchanger 16, via indirect heat exchange with another suitable refrigerant or with a stream of mixed refrigerant originating from refrigerant cycle 14. The entire resulting cooled liquid stream withdrawn from cooling pass 30 via conduit 168 as shown in FIG. 3 may be expanded via passage through expansion device 32, and the resulting two-phase stream in conduit 170 may optionally be combined in its entirety with the expanded, cooled stream in conduit 154 prior to the entire combined stream in conduit 156 entering vapor-liquid separator 22 and proceeding as described previously with respect to FIG. 1.

As shown in FIG. 3, a light component-enriched vapor phase stream, which, in some embodiments may be a $C_1$-enriched stream, can be withdrawn from the upper vapor outlet of distillation column 212 via conduit 252. In one embodiment, the vapor phase stream in conduit 252 may include at least about 20 volume percent, at least about 40 volume percent, at least about 60 volume percent, or at least about 80 volume percent of $C_1$ and lighter components and/or may include less than about 70 volume percent, less than about 50 volume percent, less than about 10 volume percent, less than about 5 volume percent, or less than about 2 volume percent of $C_2$ and heavier components, based on the total volume of the stream.

As shown in FIG. 3, the overhead vapor stream in conduit 252 can be introduced into a cooling pass 214 disposed within primary heat exchanger 16, wherein the stream may be cooled and at least partially condensed via indirect heat exchange with the stream of mixed refrigerant as discussed in detail previously. In another embodiment, the overhead stream in conduit 252 can be cooled in a separate heat exchanger (not shown in FIG. 3). According to the embodiment of refrigeration facility depicted in FIG. 3, the cooled stream in conduit 254 can then be introduced into a vapor-liquid separator 216, wherein the vapor and liquid phases may be separated. As shown in FIG. 3, the liquid phase portion withdrawn from vapor-liquid separator 216 via conduit 256 can be pressurized via pump 218 before being re-introduced into the upper inlet of fractionation column 212. This liquid stream in conduit 258, which can include at least about 50 mole percent, at least about 65 mole percent, at least about 85 mole percent of $C_2$ and heavier components, may be used to remove (or absorb) components heavier than $C_1$ from the ascending vapor stream introduced at or near the bottom of fractionation column 212, thereby minimizing loss of $C_2$ and heavier components from the system. Although not shown in FIG. 3, fractionation column 212 can also include at least one reboiler at or near the bottom of the column for facilitating separation within fractionation column 212.

As shown in FIG. 3, a vapor phase product stream can be withdrawn from a vapor outlet of vapor-liquid separator 216 via conduit 260. Typically, the vapor phase stream in conduit 260 can be enriched in $C_1$ and lighter components and may comprise at least about 65 mole percent, at least about 75 mole percent, at least about 85 mole percent, or at least about 95 mole percent $C_1$. Typically, the stream in conduit 260 can also be depleted in $C_2$ and heavier components and may, for example, include less than about 20 mole percent, less than about 10 mole percent, less than about 5 mole percent, or less than about 1 mole percent of $C_2$ and heavier components. In one embodiment, at least a portion of the vapor phase product stream in conduit 260 can be removed from refrigeration facility 210 and may be routed to another location or vessel for additional processing, storage, and/or use (not shown). Depending on the volume and composition of the vapor phase product stream, at least a portion of the stream may be liquefied to produce LNG, or may be used as a fuel gas or a pipeline gas.

Figure 4:
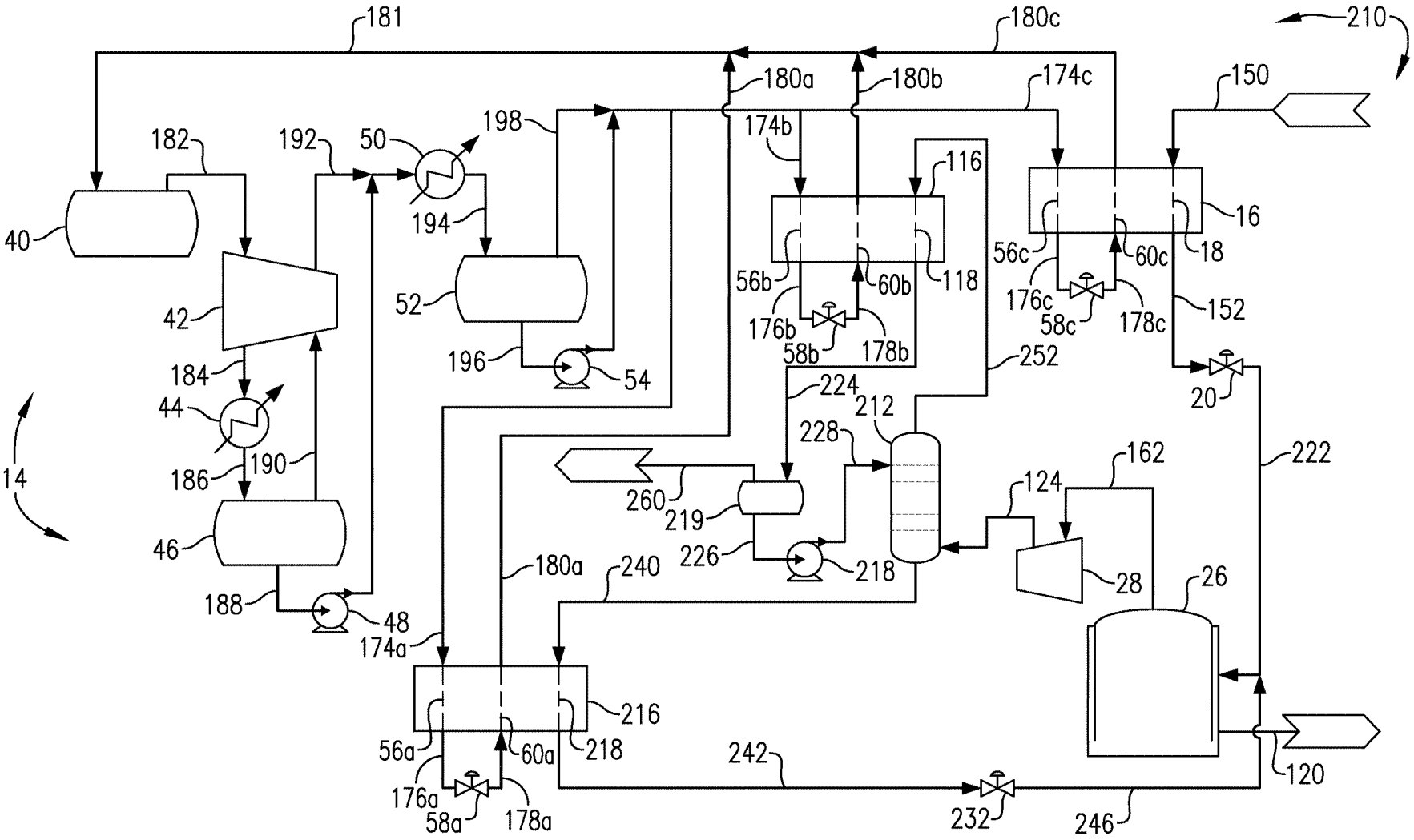
FIG. 4 provides a schematic depiction of a refrigeration system according to still another embodiment of the present invention, similar to the refrigeration system depicted in FIG. 3, but configured without a vapor-liquid separation vessel.

Turning now to FIG. 4, a schematic depiction of another embodiment of a refrigeration facility 210 is provided. As described in detail previously with respect to FIG. 3, refrigeration facility 210 generally includes a primary heat exchanger 16, a holding vessel, shown as storage tank 26, a fractionation column 212, and a closed-loop mixed refrigerant cycle 14. Additionally, refrigeration facility 210 shown in FIG. 4 includes separate second and third heat exchangers 116 and 216 and a single, multistage flash gas compressor 28. Additionally, refrigeration facility 210 shown in FIG. 4 does not include a separation vessel 22. The operation of the refrigeration facility 210 shown in FIG. 4 will now be described in detail, as it differs from that facility 210 described previously with respect to FIG. 3.

Turning to FIG. 4, the expanded feed stream in conduit 222 can be introduced into storage tank 26. When present, a stream of boil-off vapor can be withdrawn from storage tank 26 and introduced into a compressor, shown as a single, multi-stage compressor 28, wherein the pressure of the stream can be increased. The resulting compressed stream in conduit 124 may then be introduced into a lower inlet of fractionation column 212, wherein the stream can be separated into a light component-enriched overhead stream in conduit 252 and a light component-depleted bottoms stream in conduit 240, whereafter the streams may proceed as described previously with respect to FIG. 3.

As shown in FIG. 4, the light component-enriched overhead stream withdrawn from fractionation column 212 via conduit 252 can be cooled in a cooling pass 118 of second heat exchanger 116, via indirect heat exchange with a yet-to-be-discussed stream of mixed refrigerant in warming pass 60*b*. According to one embodiment (not shown in FIG. 4), cooling pass 118 can be contained within primary heat exchanger 16. The cooled, at least partially condensed, overhead stream in conduit 224 withdrawn from second heat exchanger 116 can be introduced into a vapor-liquid separator 219, wherein the vapor and liquid portions can be separated. As described in detail previously, the liquid portion in conduit 226 can be pumped via pump 218 and introduced into an upper portion of fractionation column 212 as a reflux stream, while the vapor portion of the cooled stream removed from vapor-liquid separator 219 via conduit 260 can be routed for further processing, storage, and/or use.

According to the embodiment depicted in FIG. 4, the light component-depleted liquid stream withdrawn from the lower portion of fractionation column 212 in conduit 240 may also be cooled via passage through a cooling pass 218 contained within a third heat exchanger 216. In another embodiment (not shown), cooling pass 218 may be contained within second heat exchanger 116 or primary heat exchanger 16. The resulting cooled liquid stream withdrawn from cooling pass 218 in conduit 242 may then be expanded via passage through an expansion device, shown in FIG. 4 as valve 232, and the resulting expanded fluid stream may then be passed via conduit 246 to a lower pressure zone, such as, for example, storage tank 26. In some embodiments, the expanded fluid stream in conduit 246 can be combined with the expanded stream in conduit 222 prior to being introduced into storage tank 26, while, in another embodiment (not shown in FIG. 4), all or a portion of the two expanded streams may be introduced separately and/or routed to different low pressure zones.

Turning now to the embodiment of closed-loop refrigeration cycle 14 depicted in FIG. 4, the combined refrigerant stream in conduit 198 may be divided into two or more portions when more than one heat exchanger is utilized in refrigeration facility 210. In one embodiment depicted in FIG. 4, the combined refrigerant stream in conduit 198 can be divided into three portions 174*a*, 174*b*, and 174*c*, which are respectively routed to respective third, second, and primary heat exchangers 216, 116, and 16, shown in FIG. 4. The first portion in conduit 174*a* can be passed through a cooling pass 56*a* contained within heat exchanger 216, wherein the stream can be cooled via indirect heat exchange with a refrigerant stream passing upwardly through warming pass 60*a*. The resulting cooled refrigerant stream withdrawn from a lower portion of heat exchanger 216 in conduit 176*a* can be expanded via passage through expansion device 58*a* and the expanded stream in conduit 178*a* can be introduced into warming pass 60*a*, wherein the stream may be used to cool the refrigerant in cooling pass 56*a* and the light component-depleted bottoms stream withdrawn from fractionation column 212 via line 240, as described in detail previously. The warmed refrigerant withdrawn from warming pass 60*a* of heat exchanger 216 can then be recombined with the yet-to-be-discussed streams of warmed refrigerant in conduits 180*b* and 180*c*, and the combined stream in conduit 181 can be routed to the refrigerant suction drum 40, before proceeding through refrigeration cycle 14 as discussed previously.

Similarly, the second and third refrigerant portions in respective conduits 174*b* and 174*c* respectively pass through a refrigerant cooling pass 56*b* and 56*c* contained within heat exchangers 116 and 16. The cooled refrigerant streams in respective conduits 176*b* and 176*c* may then be expanded via passage through separate expansion devices, shown as expansion valves 58*b* and 58*c*, before being routed to refrigerant warming passes 60*b* and 60*c*, as discussed previously. The resulting warmed refrigerant streams exiting warming passes 60*b* and 60*c* via conduit 180*b* and 180*c* can be combined with the warmed refrigerant stream in conduit 180*a* and passed via conduit 181 through refrigeration cycle 14 as previously described.

Figure 5:
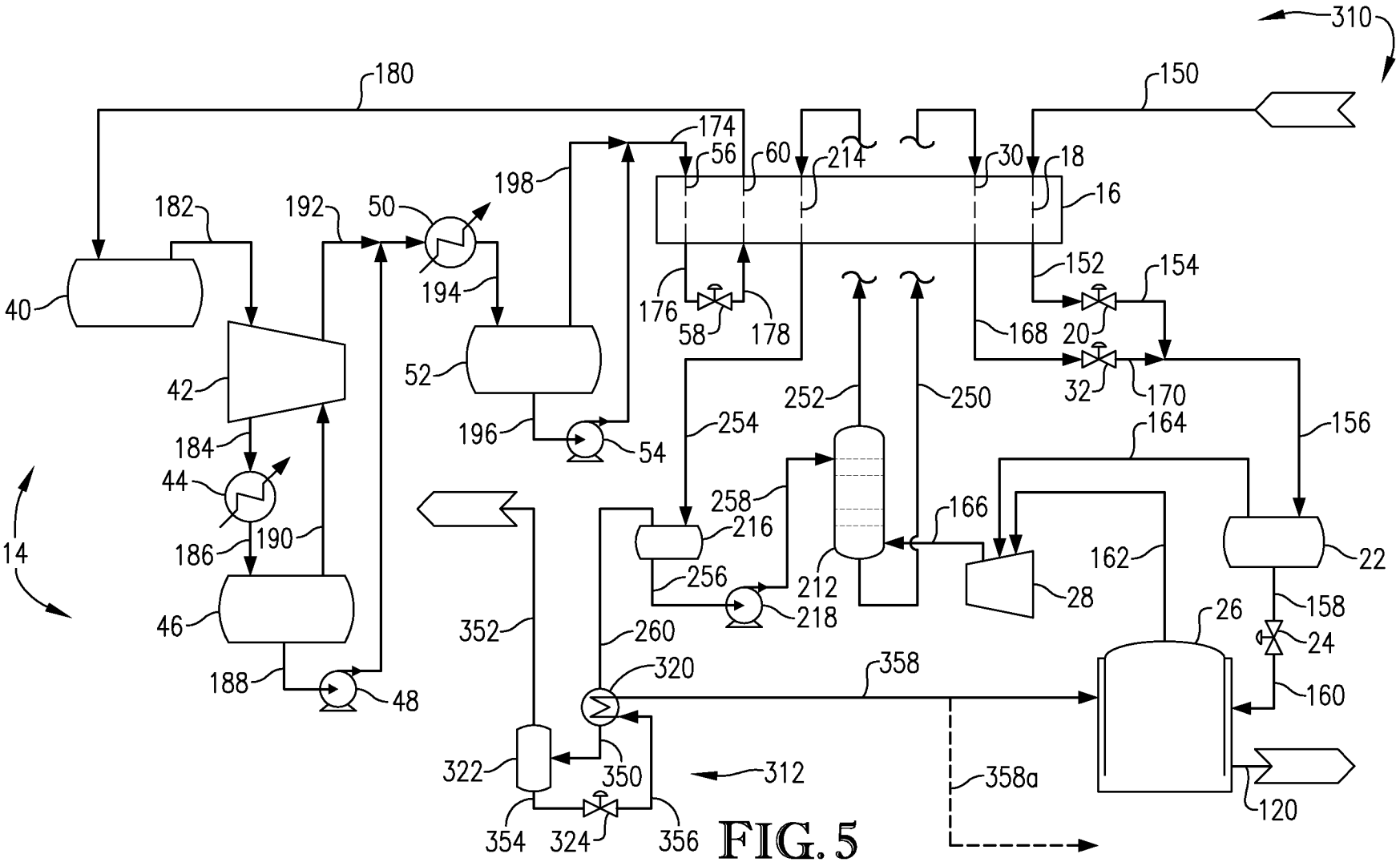
FIG. 5 provides a schematic depiction of a refrigeration system according to a further embodiment of the present invention, particularly illustrating the use of an enrichment zone for enhancing the recovery of light ends and minimizing the loss of hydrocarbon components.

Referring now to FIG. 5, a schematic depiction of a refrigeration facility 310 configured according to another embodiment of the present invention is provided. Refrigeration facility 310 is illustrated as generally comprising a primary heat exchanger 16, a vapor-liquid separator 22, a storage tank 26, flash gas compressor 28, a fractionation column 212, a vapor-liquid separator 216, and a closed-loop mixed refrigerant cycle 14, each of which is configured in a similar manner to those described previously with respect to refrigeration facilities 110 and 210 shown in FIGS. 1 and 3. In addition, refrigeration facility 310 shown in FIG. 5 also includes an enrichment zone 312, which includes a cooler 320 and a vapor-liquid separator 322 to further separate the vapor stream recovered from fractionation column 212. In addition to increasing the content of light components, including, for example, $C_1$ and lighter components, recovered in the predominantly vapor stream in line 352, use of enrichment zone 312 also facilitates increased content of lighter components, such as, for example, $C_1$ components, in the predominantly liquid stream in conduit 358 and, ultimately, in product stream 120. The operation of refrigeration facility 310, as it differs from that of refrigeration facilities 110 and 210 described previously, will now be discussed in detail below, with respect to FIG. 5.

Turning initially to vapor-liquid separator 216 shown in FIG. 5, the vapor phase stream withdrawn from an upper vapor outlet of separator 216 can be routed via conduit 260 to a cooler 320, wherein the stream can be cooled and at least partially condensed via indirect heat exchange with a yet-to-be-discussed stream in conduit 356. The resulting cooled stream withdrawn from cooler 320 via conduit 350 can be introduced into vapor-liquid separator 322, herein the vapor and liquid phases can be separated. The resulting vapor stream, which can comprise at least about 85 mole percent, at least about 95 mole percent, at least about 97 mole percent, or at least about 99 mole percent of $C_1$ and lighter components, can be withdrawn from vapor-liquid separator 322 via conduit 352 and may be used as a vapor phase product stream as described above. In one embodiment, at least about 75 percent, at least about 85 percent, or at least about 95 percent of the total amount of $C_1$ and lighter components introduced into separator 322 may be present in the vapor stream in conduit 352 and all or a portion of the stream may be routed to a downstream facility or vessel for further processing, transportation, and/or storage, as discussed in detail previously.

As shown in FIG. 5, the liquid phase stream withdrawn from a lower outlet of vapor-liquid separator 322 via conduit 354 can be passed through an expansion device, shown as a valve 324, wherein the stream may be flashed and cooled. The resulting stream can then be passed to cooler 320 via conduit 356, wherein it may be used to cool the vapor phase stream in conduit 260. Prior to being introduced into cooler 320, the expanded stream in conduit 356 can have a temperature of at least about −250° F., at least about −200° F., at least about −160° F. and/or not more than about −100° F., not more than about −125° F., not more than about −140° F. The resulting warmed stream in conduit 358, which can have a temperature that is at least about 25° F., at least about 50° F., or at least about 75° F. warmer than the stream in conduit 356, can be passed into storage tank 26 via conduit 358 as shown in FIG. 5, or can be routed to another suitable lower pressure zone (not shown in FIG. 5) via conduit 358*a*.

The following example is for purposes of illustration only and is not intended to be unnecessarily limiting.

Example

Computer simulations of several different refrigeration facilities were performed using ASPEN® HYSYS process modeling software (available from Aspen Technology, Inc.) and are summarized in Tables 2 and 3. Two of the simulated facilities, Comparative Facility A and Comparative Facility B, included open-loop cascade refrigeration systems for cooling a feed stream. The other four facilities modeled for this Example, Inventive Facilities 1-4, included a single closed-loop mixed refrigerant system for cooling the incoming fluid stream. Schematic diagrams of each of Inventive Facilities 1-3 are provided in FIGS. 1, 3, and 5, respectively, and Inventive Facility 4 is configured similarly to Inventive Facility 3, but employs turboexpanders rather than expansion valves for enhanced energy recovery. Schematic diagrams of Comparative Facilities A and B are provided in FIGS. 6 and 7, respectively. The configurations of Inventive Facilities 1-4 were discussed previously, and details regarding the basic configuration of Comparative Facilities A and B will now be discussed below.

Figure 6:
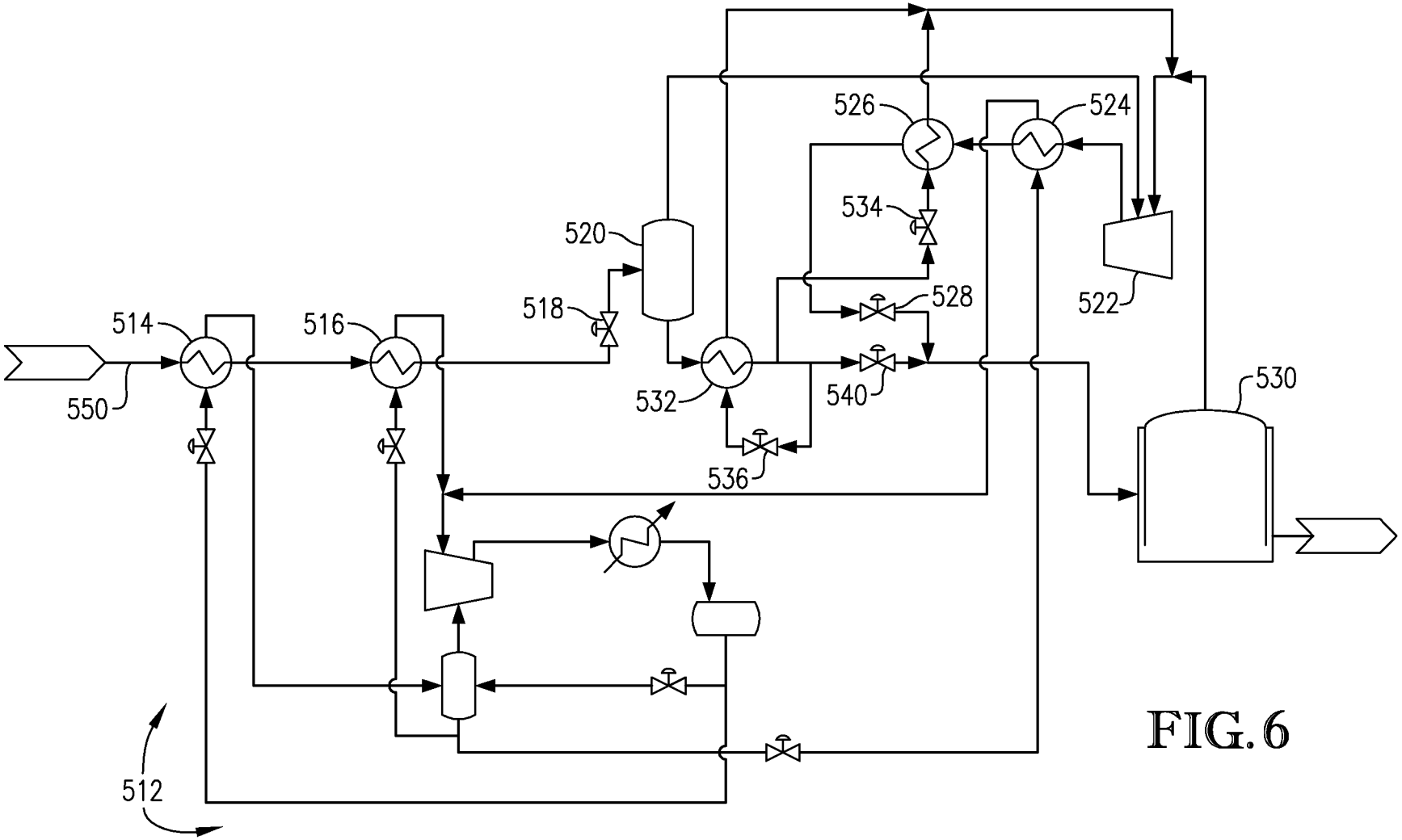
FIG. 6 provides a schematic depiction of a comparative refrigeration system used to cool a hydrocarbon-containing feed stream that was simulated for comparison with inventive refrigeration systems in the Example.

Turning first to the Comparative Facility A depicted in FIG. 6, a feed stream, enriched in $C_2$ and heavier components, in conduit 550 passes through a series of heat exchangers 514 and 516, wherein it is cooled to a temperature of −30° F. via indirect heat exchange with a stream of refrigerant originating from a closed-loop propylene refrigeration cycle 512. The resulting cooled fluid stream exiting exchanger 516 is flashed in expansion device 518 and the cooled, expanded stream is separated in a flash tank 520 at a temperature of −72° F. and a pressure of 47 psig. The vapor portion of the stream withdrawn from flash tank 520 is routed to flash gas compressor 522, wherein it is compressed and the resulting compressed stream exiting compressor 522 is first cooled via indirect heat exchange with air or water in an exchanger (not shown) and then in heat exchanger 524 with a stream of propylene refrigerant, followed by heat exchanger 526 with a $C_2$-rich stream originating from the feed. The resulting cooled stream is flashed again using expansion device 528, and the cooled, near-atmospheric pressure fluid stream is then passed to a holding vessel 530, as shown in FIG. 6.

In addition to propylene refrigeration cycle 512, at least a portion of the cooling of the feed stream in conduit 550 is carried out using an open-loop refrigeration cycle that employs a portion of the cooled feed. In particular, as shown in FIG. 6, the liquid phase withdrawn from flash tank 520 is cooled to a temperature of −110° F. in an exchanger 532 and then divided into two refrigerant portions and a liquid portion. The liquid portion is expanded with expansion valve 540 and then combined with the cooled compressed stream introducing into holding vessel 530. One of the refrigerant portions is flashed via passage through an expansion device 534 and the resulting stream, which has a temperature of −116° F., is used to cool the compressed stream in heat exchanger 526. The other refrigerant portion is also flashed to a temperature of −116° F. via expansion device 536 and is used to cool the liquid stream withdrawn from flash tank 520 in exchanger 532. The resulting warmed streams are combined and then introduced into flash gas compressor 522, along with a stream of boil-off vapor withdrawn from holding vessel 530. As shown in FIG. 6, Comparative Facility A does not utilize a fractionation column for removing light ends from the feed stream.

Figure 7:
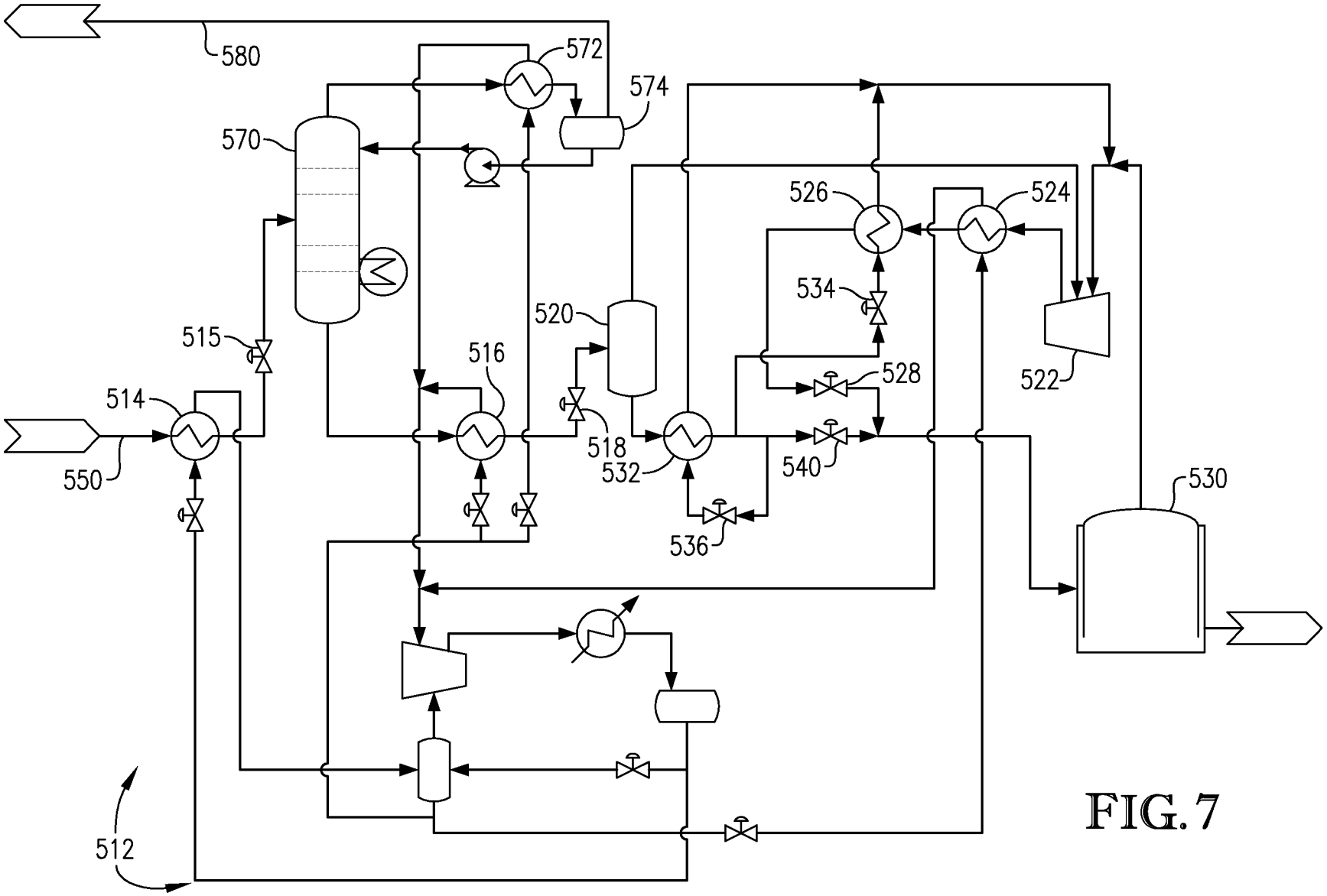
FIG. 7 provides a schematic depiction of another comparative refrigeration system used to cool a hydrocarbon-containing feed stream that was also simulated for comparison with inventive refrigeration systems in the Example.

Turning now to FIG. 7, a schematic depiction of Comparative Facility B, which was also simulated for this Example, is provided. As shown in FIG. 7, Comparative Facility B is configured in a similar manner as Comparative Facility A, except Comparative Facility B includes a fractionation column 570, disposed between heat exchangers 514 and 516 of propylene refrigeration cycle 512, for separating methane and lighter components from the incoming feed. As shown in FIG. 7, the cooled fluid stream exiting heat exchanger 514 is flashed via passage through expansion device 515 before being introduced into fractionation column 570. The overhead vapor withdrawn from fractionation column 570 is cooled and partially condensed via indirect heat exchange with a propylene refrigerant in a condenser 572 before being separated into vapor and liquid portions in an accumulator 574. The non-condensed light ends are removed from the system via conduit 580, while the liquid stream is returned to fractionation column 570 as reflux. The temperature of the reflux stream is −30° F.

The liquid bottoms stream withdrawn from fractionation column 570 is cooled in heat exchanger 516 of propylene refrigeration cycle 512 and passes through the remainder of Comparative Facility B in a similar manner as discussed in detail previously with respect to Comparative Facility A illustrated in FIG. 6. As with Comparative Facility A, Comparative Facility B utilizes an open-loop refrigerant system positioned downstream of flash tank 520 to further cool the incoming stream in exchangers 526 and 532. Additionally, similarly to Comparative Facility A shown in FIG. 6, Comparative Facility B includes a flash gas compressor 522 for compressing the vapor stream withdrawn from flash tank 520 and any boil-off vapor removed from holding vessel 530.

Each of Comparative Facilities A and B and Inventive Facilities 1-4 described above was simulated twice—once with a high methane content feed stream (e.g., 3.0 volume percent methane) and once with a lower methane content feed stream (e.g., 1.0 volume percent methane). The results of each simulation, including the composition of the liquid $C_2$ product and the methane off-gas product, if present, are provided in Table 2 (High Methane Content) and Table 3 (Lower Methane Content) below. Additionally, Tables 2 and 3 provide the overall net power requirements for each simulation.

TABLE 2

Results of Simulation for Comparative Facilities A & B and Inventive Facilities 1-4
High Methane Content

| | Comparative Facility A | Comparative Facility B | Inventive Facility 1 | Inventive Facility 2 | Inventive Facility 3 | Inventive Facility 4 |
|---|---|---|---|---|---|---|
| Figure | FIG. 6 | FIG. 7 | FIG. 1 | FIG. 3 | FIG. 5 | FIG. 5 w/expander |
| Feed Liquid | | | | | | |
| Flow Rate (BPD) | 100,000 | 100,000 | 100,000 | 100,000 | 100,000 | 100,000 |
| Temperature (° F.) | 97 | 97 | 97 | 97 | 97 | 97 |
| Pressure (psig) | 850 | 850 | 850 | 850 | 850 | 850 |
| Methane Content (LV %) | 3.00 | 3.00 | 3.00 | 3.00 | 3.00 | 3.00 |
| Ethane Content (LV %) | 95.46 | 95.46 | 95.46 | 95.46 | 95.46 | 95.46 |
| Propane Content (LV %) | 1.54 | 1.54 | 1.54 | 1.54 | 1.54 | 1.54 |
| Fractionation Column | | | | | | |
| Present? | No | Yes | No | Yes | Yes | Yes |
| Location | — | Feed | — | Flash Gas | Flash Gas | Flash Gas |
| Feed Rate (lbmol/hr) | — | 17,567 | — | 3,418 | 3,732 | 3,346 |
| Ethane Product | | | | | | |
| Methane Content (LV %) | 3.0 | 0.5 | 3.0 | 0.36 | 0.41 | 0.46 |
| Volume to Tank (BPD) | 100,000 | 93,320 | 100,000 | 96,000 | 97,000 | 97,060 |
| Methane-rich Off-Gas | | | | | | |
| Flow Rate (MMscfd) | — | 12.8 | — | 8.7 | 7.1 | 6.9 |
| Ethane content (mol %) | — | 50 | — | 24 | 9 | 9 |
| Compression Power (hp) | | | | | | |
| Flash Gas/Ethane Compressor | 25,395 | 10,511 | 8,754 | 3,387 | 3,723 | 3,459 |
| Propylene Compressor | 25,404 | 20,492 | — | — | — | — |
| Mixed Refrigerant Compressor | — | — | 37,454 | 21,227 | 22,061 | 21,463 |
| TOTAL | 50,763 | 31,003 | 46,208 | 24,614 | 25,784 | 24,923 |
| Expander Generator Power | — | — | — | | — | (870) |
| TOTAL (NET) | — | — | — | | — | 24,053 |

35

TABLE 3

Results of Simulation for Comparative Facilities A & B and Inventive Facilities 1-4
Lower Methane Content

| | Comparative Facility A | Comparative Facility B | Inventive Facility 1 | Inventive Facility 2 | Inventive Facility 3 | Inventive Facility 4 |
|---|---|---|---|---|---|---|
| Figure | FIG. 6 | FIG. 7 | FIG. 1 | FIG. 3 | FIG. 5 | FIG. 5 w/expander |
| Feed Liquid | | | | | | |
| Flow Rate (BPD) | 100,000 | 100,000 | 100,000 | 100,000 | 100,000 | 100,000 |
| Temperature (° F.) | 97 | 97 | 97 | 97 | 97 | 97 |
| Pressure (psig) | 850 | 850 | 850 | 850 | 850 | 850 |
| Methane Content (LV %) | 1.00 | 1.00 | 1.00 | 1.00 | 1.00 | 1.00 |
| Ethane Content (LV %) | 95.50 | 95.50 | 95.50 | 95.50 | 95.50 | 95.50 |
| Propane Content (LV %) | 3.50 | 3.50 | 3.50 | 3.50 | 3.50 | 3.50 |
| Fractionation Column | | | | | | |
| Present? | No | Yes | No | Yes | Yes | Yes |
| Location | — | Feed | — | Flash Gas | Flash Gas | Flash Gas |
| Feed Rate (Lbmol/hr) | — | 17,357 | — | 2,885 | 2,949 | 2,618 |
| Ethane Product | | | | | | |
| Methane Content (LV %) | 1.0 | 0.5 | 1.0 | 0.13 | 0.16 | 0.18 |
| Volume to Tank (BPD) | 100,000 | 98,660 | 100,000 | 98,700 | 90,030 | 99,060 |
| Methane-rich Off-Gas | | | | | | |
| Flow Rate (MMscfd) | — | 2.6 | — | 2.8 | 2.3 | 2.3 |
| Ethane content (mol %) | — | 50 | — | 24 | 9 | 9 |

TABLE 3-continued

Results of Simulation for Comparative Facilities A & B and Inventive Facilities 1-4
Lower Methane Content

| | Comparative Facility A | Comparative Facility B | Inventive Facility 1 | Inventive Facility 2 | Inventive Facility 3 | Inventive Facility 4 |
|---|---|---|---|---|---|---|
| Compression Power (hp) | | | | | | |
| Flash Gas/Ethane Compressor | 13,200 | 10,952 | 6,148 | 3,093 | 3,083 | 2,829 |
| Propylene Compressor | 20,180 | 19,543 | — | — | — | — |
| Mixed Refrigerant Compressor | — | — | 24,154 | 19,661 | 19,884 | 19,352 |
| TOTAL | 33,380 | 30,495 | 30,302 | 22,754 | 22,967 | 22,174 |
| Expander Generator Power | — | — | — | | — | (780) |
| TOTAL (NET) | — | — | — | | — | 21,394 |

Figure 8:
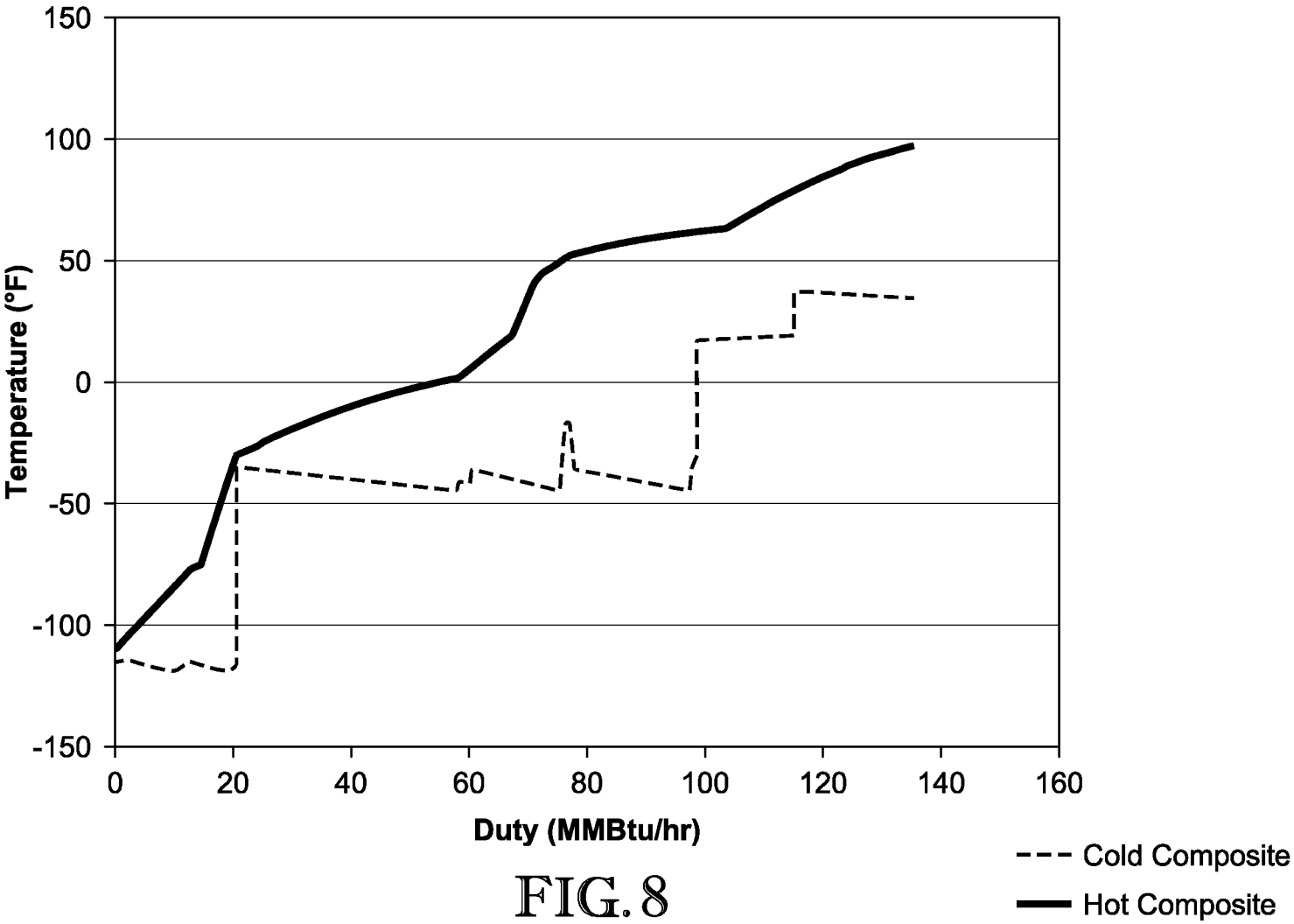
FIG. 8 is a graphical depiction of the composite cooling curve of a comparative open-loop refrigeration cycle used in a refrigeration facility simulated in the Example.
Figure 9:
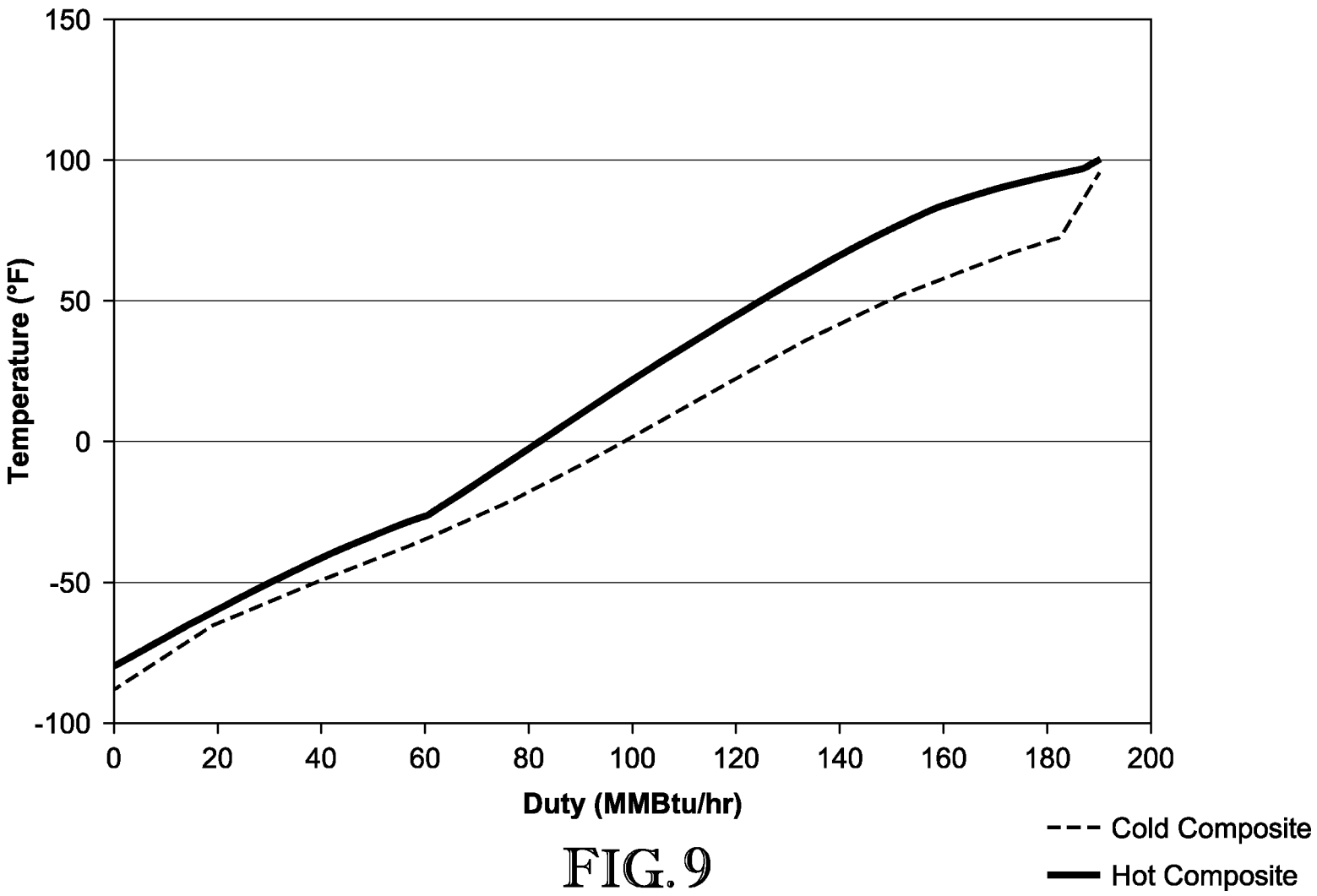
FIG. 9 is a graphical depiction of the composite cooling curve of an inventive closed-loop refrigeration cycle used in a refrigeration facility simulated in the Example.

Additionally, FIG. 8 provides a graphical depiction of the composite cooling curves for an open-loop cascade refrigeration system as described with respect to FIGS. 6 and 7, and FIG. 9 provides a graphical depiction of the composite cooling curve for a closed loop mixed refrigerant system as shown in FIGS. 1-5. As shown by a comparison of the two graphs, the close tracking between the hot and cold composite curves of FIG. 9 indicates that the closed loop mixed refrigerant systems configured according to embodiments of the present invention are capable of more efficiently cooling a feed stream than conventional open-loop cascade cooling systems.

The higher efficiency of embodiments of the present invention can result in lower annual operating expenses and lower capital investment due to the reduced total compression requirement, as indicated in Tables 2 and 3. Additional capital investment savings and reduced facility footprint can also result from the reduced equipment count, as compared to the conventional technology as shown in FIGS. 6 and 7. Further, in the present invention, light component removal can be accomplished in a smaller flash gas stream as opposed to the main feed stream, as would be the case for the conventional technology. The much lower fractionation column feed rates shown in Tables 2 and 3 according to embodiments of the present invention can facilitate further reduction in the capital investment and footprint as compared to conventional technology.

The preferred forms of the invention described above are to be used as illustration only and should not be used in a limiting sense to interpret the scope of the present invention. Obvious modifications to the exemplary embodiments, set forth above, could be readily made by those skilled in the art without departing from the spirit of the present invention. The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method for providing a cooled, reduced-pressure hydrocarbon-containing stream, said method comprising:

(a) cooling a hydrocarbon-containing stream via indirect heat exchange with a mixed refrigerant in a closed-loop mixed refrigerant system to provide a warmed refrigerant and a cooled stream;

(b) flashing said cooled stream to provide a two-phase fluid stream, wherein said two-phase fluid stream includes the entire hydrocarbon-containing stream;

(c) introducing said two-phase fluid stream into a separator vessel;

(d) separating said two-phase fluid stream in said separator vessel to form a vapor fraction and a liquid fraction;

(e) introducing said liquid fraction into a holding vessel;

(f) compressing said vapor fraction to provide a compressed vapor stream;

(g) cooling at least a portion of said compressed vapor stream in a heat exchanger to provide a second cooled fluid stream;

(h) withdrawing said second cooled fluid stream from an outlet of said heat exchanger, wherein said second cooled fluid stream is a liquid stream; and (i) introducing the entirety of said second cooled fluid stream into said separator vessel with said two-phase fluid stream, wherein prior to said cooling of step (a) said hydrocarbon-containing stream has a vapor fraction of less than about 0.10, wherein said cooling of step (a) is performed in a first cooling pass of said heat exchanger and said cooling of step (g) is performed in a second cooling pass of said heat exchanger, and wherein said first and said second cooling passes are separate from one another; and wherein prior to said cooling of step (g) at least a portion of said compressed vapor stream is separated into a light component-enriched overhead stream and a light component-depleted bottoms stream in a fractionation column, and wherein said cooling of step (g) comprises cooling said light component-depleted bottoms stream to form said second cooled fluid stream, withdrawing a liquid stream from said holding vessel, wherein said liquid stream comprises less than about 5 mole percent of $C_1$ and lighter components and has a pressure within about 10 psig of atmospheric pressure, and wherein said hydrocarbon-containing stream comprises at least about 50 volume percent of $C_2$ and heavier components.

2. The method of claim 1, further comprising cooling at least a portion of said light component-enriched overhead stream to provide a cooled overhead stream; separating the cooled overhead stream into an overhead vapor fraction and a reflux liquid fraction; and introducing at least a portion of the reflux liquid fraction into an upper portion of said fractionation column, wherein at least a portion of said cooling of said light component-enriched overhead stream is carried out via indirect heat exchange with said mixed refrigerant in said closed-loop mixed refrigeration system.

3. The method of claim 1, further comprising, prior to said introducing of step (e), flashing at least a portion of said liquid fraction to form a flashed liquid stream and introducing at least a portion of said flashed liquid stream into said holding vessel.

4. The method of claim 1, further comprising, compressing a stream of boil-off vapor withdrawn from an upper portion of said holding vessel to provide a compressed boil-off stream, wherein said compressed vapor stream comprises at least a portion of said compressed boil-off stream.

5. The method of claim 1, wherein at least a portion of said cooling of step (g) is carried out via indirect heat exchange between said at least a portion of said compressed vapor stream and said mixed refrigerant in said closed-loop mixed refrigeration system.

6. The method of claim 1, wherein said holding vessel is selected from the group consisting of a storage tank, a barge, a truck, a rail car, a ship, and combinations thereof.

7. The method of claim 1, wherein said hydrocarbon-containing stream is a supercritical fluid stream prior to said cooling of step (a).

8. The method of claim 1, wherein said separator vessel comprises a single separation stage.

9. The method of claim 1, wherein said cooling of step (g) is performed via indirect heat exchange with said mixed refrigerant used during said cooling of step (a).

* * * * *